US007306265B1

(12) United States Patent
Green et al.

(10) Patent No.: US 7,306,265 B1
(45) Date of Patent: Dec. 11, 2007

(54) PUSH BUTTON ACTUATOR

(75) Inventors: Robin T. Green, Tillsonburg (CA); Leslie A. Farkas, Delhi (CA)

(73) Assignee: The Eastern Company, Naugatuck, CT (US)

( * ) Notice: Subject to any disclaimer, the term of this patent is extended or adjusted under 35 U.S.C. 154(b) by 82 days.

(21) Appl. No.: 10/896,409

(22) Filed: Jul. 21, 2004

(51) Int. Cl.
*E05C 3/02* (2006.01)

(52) U.S. Cl. ..... 292/194; 292/DIG. 37; 70/360; 70/361

(58) Field of Classification Search ..... 292/194, 292/336.3, DIG. 37; 70/360 X, 361 X, 447, 70/386, 81, 83; 403/348, 349
See application file for complete search history.

(56) References Cited

U.S. PATENT DOCUMENTS

| | | | | |
|---|---|---|---|---|
| 417,589 | A | 12/1889 | Rose | |
| 491,824 | A | 2/1893 | Walker | |
| 767,567 | A | 8/1904 | Keil | |
| 876,300 | A | 1/1908 | Couret | |
| 925,455 | A | 6/1909 | Campbell | |
| 1,018,077 | A | 2/1912 | Petterson | |
| 1,058,346 | A | 4/1913 | Berstler | |
| 1,174,652 | A | 3/1916 | Banks | |
| 1,368,141 | A | 2/1921 | Hagstrom | |
| 1,571,453 | A | 2/1926 | Maxon | |
| 1,662,423 | A | 3/1928 | Jacobi | |
| 1,672,901 | A | 6/1928 | North | |
| 1,937,165 | A | 11/1933 | Piagneri | 70/53 |
| 1,965,939 | A | 7/1934 | Jacobi | 70/29 |
| 2,033,252 | A | 3/1936 | Parker | 200/11 |
| 2,059,479 | A | 11/1936 | North | 292/127 |
| 2,118,012 | A | 5/1938 | Lowe | 200/44 |
| 2,257,741 | A | 10/1941 | Gray | 70/85 |
| 2,261,472 | A | 11/1941 | Hurd | 70/455 |
| 2,322,040 | A | 6/1943 | Maruri | 70/145 |
| 2,580,548 | A | 1/1952 | Jacobi | 70/370 |
| 2,617,290 | A | 11/1952 | Schwartz | 70/452 |
| 2,623,959 | A | 12/1952 | Jarrett | 200/42 |
| 2,662,131 | A | 12/1953 | Cerna et al. | 200/44 |
| 2,683,978 | A * | 7/1954 | Jacobi | 70/360 |
| 2,689,700 | A | 9/1954 | Drury | 248/27 |
| 2,695,932 | A | 11/1954 | Jacobi | 200/11 |
| 2,705,884 | A | 4/1955 | Craig | 70/264 |
| 2,728,214 | A * | 12/1955 | Craig | 70/149 |
| 2,744,405 | A | 5/1956 | McClelland | 70/81 |
| 2,755,519 | A | 7/1956 | Xander | 20/52 |

(Continued)

*Primary Examiner*—Jennifer H. Gay
*Assistant Examiner*—Mark Williams
(74) *Attorney, Agent, or Firm*—David A. Burge

(57) ABSTRACT

A panel-mountable push button actuator assembly for operating a latch or other apparatus having a link, trigger or other operating element that must move a short distance includes a housing having a front portion configured to be inserted through a panel opening from the rear side of the panel, and a generally annular retaining cap that is releasably connected to the front portion of the housing to hold the housing in the panel opening. The cap preferably is held in its installed position on the housing by a compressed foam rubber washer that provides a seal between the cap and the panel. Also disclosed are an O-ring seal that optionally may be interposed between a push button of the actuator assembly and the housing, and a rigidified cam that may be used with the present and other types of push button actuator assemblies to engage and move a link, trigger or other operating element in response to depression of the push button.

38 Claims, 9 Drawing Sheets

U.S. PATENT DOCUMENTS 2,772,908 A 12/1956 Craig ..... 292/280
2,987,907 A 6/1961 Cockburn et al. ..... 70/135
3,146,010 A 8/1964 Dellith ..... 292/212
3,964,280 A 6/1976 Kelton ..... 70/84
4,113,227 A 9/1978 Cigliano ..... 151/54
4,488,669 A 12/1984 Waters ..... 229/273
4,586,354 A 5/1986 Smith ..... 70/451
4,598,563 A * 7/1986 Berkowitz ..... 70/492
4,635,454 A 1/1987 Brown ..... 70/139
4,635,980 A 1/1987 De Luca ..... 292/281
4,638,652 A 1/1987 Morse et al. ..... 70/454
4,640,478 A 2/1987 Leigh-Monstevens ..... 248/27.1
4,759,204 A * 7/1988 Neyret ..... 70/360
4,794,772 A 1/1989 Falk et al. ..... 70/491
4,803,314 A 2/1989 Sorenson et al. ..... 200/11 J
4,912,951 A 4/1990 Weinerman et al. ..... 70/99
4,978,152 A 12/1990 Bisbing ..... 292/169
5,018,373 A 5/1991 Weinerman et al. ..... 70/99
D318,217 S 7/1991 Weinerman et al. ..... D8/331
D324,635 S 3/1992 Weinerman et al. ..... D8/331
5,263,348 A * 11/1993 Wittwer ..... 70/379 R
5,265,453 A * 11/1993 Konii et al. ..... 70/379 R
5,308,126 A 5/1994 Weger, Jr. et al. ..... 292/53
5,435,159 A * 7/1995 Ramsauer ..... 70/370
5,689,980 A 11/1997 Weinerman ..... 70/208
5,816,630 A 10/1998 Bennett et al. ..... 292/341.17
5,853,261 A * 12/1998 Keruzore ..... 403/350
6,067,827 A 5/2000 Haseley et al. ..... 70/370
6,113,160 A 9/2000 Johansson et al. ..... 292/169
D432,389 S 10/2000 Johansson et al. ..... D8/331
6,231,091 B1 5/2001 Gleason et al. ..... 292/34
D445,015 S 7/2001 Weinerman et al. ..... D8/302
D447,042 S 8/2001 Weinerman et al. ..... D8/330
6,322,284 B1 * 11/2001 Bonardo et al. ..... 403/348
D463,247 S 9/2002 Weinerman et al. ..... D8/330
6,454,320 B1 9/2002 Weinerman et al. ..... 292/56
D464,555 S 10/2002 Weinerman et al. ..... D8/330
D467,786 S 12/2002 Weinerman et al. ..... D8/330
D471,426 S 3/2003 Weinerman et al. ..... D8/330
D471,427 S 3/2003 Weinerman et al. ..... D8/330
D472,449 S 4/2003 Weinerman et al. ..... D8/330
D474,098 S 5/2003 Weinerman et al. ..... D8/330
D474,673 S 5/2003 Weinerman et al. ..... D8/330
6,564,602 B2 5/2003 Gregory ..... 70/360
6,575,503 B1 6/2003 Johansson et al. ..... 292/170
6,640,592 B2 * 11/2003 Vickers ..... 70/83
6,755,449 B2 * 6/2004 Weinerman et al. ..... 292/198
6,782,725 B2 * 8/2004 Linares ..... 70/360
6,843,082 B2 * 1/2005 Vickers ..... 70/83
6,861,602 B2 * 3/2005 Juga ..... 200/341

* cited by examiner

PUSH BUTTON ACTUATOR

BACKGROUND OF THE INVENTION

The present invention relates to push button actuator assemblies of the type that may be used to operate latches, locks and other apparatus having links, triggers or other operating elements that need to be moved relatively short distances to accomplish a desired result. More particularly, the present invention relates to panel mountable push button actuator assemblies of the type having a housing with a front portion that can be inserted from the rear side of a panel through a panel opening and secured in place by attaching an annular cap that prevents the inserted front portions of the housing from moving back through the panel opening—a cap that preferably is held in place by a compressed, resilient foam rubber washer that provides a seal between the panel and the cap. Other push button actuator improvement features include seal components that optionally can be incorporated within the housing to prevent the passage of moisture therethrough, and a cam rigidified against bending that may be used with the subject and other forms of push button actuator assemblies.

Push button actuator assemblies that can be installed in openings formed through panels such as control panels, or the upstanding walls of toolboxes, industrial cabinets and the like, are well known. Patent properties of Eberhard Manufacturing Company division of The Eastern Company, owner of the present invention, that disclose panel mountable push button actuator assemblies include U.S. Pat. No. 6,755,449 issued Jun. 29, 2004 to Lee S. Weinerman et al, U.S. Pat. No. 6,543,821 issued Apr. 8, 2003 to Lee S. Weinerman et al, U.S. Pat. No. 6,454,320 issued Sep. 24, 2002 to Lee S. Weinerman et al, and application Ser. No. 10/227,929 filed Aug. 26, 2002 by Lee S. Weinerman et al, collectively referred to hereinafter as the "Push Button Actuator Patents," the disclosures of which are incorporated herein by reference.

Design patents of Eberhard Manufacturing Company division of The Eastern Company that disclose appearance features of push button actuators or linkages that may be attached to and operated by push button actuators include Pat. D-474,673 issued May 20, 2003 to Lee S. Weinerman et al, Pat. D-474,098 issued May 6, 2003 to Lee S. Weinerman et al, Pat. D-472,449 issued Apr. 1, 2003 to Lee S. Weinerman et al, Pat. D-471,427 issued Mar. 11, 2003 to Lee S. Weinerman et al, Pat. D-471,426 issued Mar. 11, 2003 to Lee S. Weinerman et al, Pat. D-467,786 issued Dec. 31, 2002 to Lee S. Weinerman et al, Pat. No. D-464,555 issued Oct. 22, 2002, Pat. D-463,247 issued Sep. 24, 2002, Pat. D-447, 042, issued Aug. 28, 2001, and Pat. D-445,015 issued Jul. 17, 2001 to Lee S. Weinerman et al, referred to hereinafter as the Push Button Actuator Design Patents," the disclosures of which are incorporated herein by reference.

The push button actuator assemblies disclosed in the referenced Push Button Actuator patents typically feature housings that extend about passages wherein push buttons are mounted for translatory movement between normal, forwardly extended positions, and operated, rearwardly extended positions. Cams are mounted on rear end regions of the push buttons, move forwardly and rearwardly with the push buttons, and may be turned between locked and unlocked positions by turning correctly configured keys that are inserted into keyways defined by the push buttons. When the push buttons are depressed while in an unlocked state (i.e., their cams are in unlocked positions), their cams align with, engage and move links, triggers or other forms of operating elements of latches, locking systems, or the like. When the push buttons are depressed while in a locked state (i.e., the cams are in locked positions), the cams disalign with, fail to engage, and fail to move the links, triggers or other operating elements.

The linkage assemblies that are disclosed in the referenced Push Button Actuator Design Patents are designed to be mounted on and operated by push button actuator assemblies of the type disclosed in the referenced Push Button Actuator Patents; and, the push button actuator assemblies are designed to be installed in openings formed through panels, such as control panels or the upstanding side walls of tool boxes or the like to operate latching and locking components of various types. When one of the push button actuator assemblies is to be installed in a panel opening, installation is effected from the front side of the panel by moving rear portions of the actuator assembly through the panel opening until a position is reached where a rearwardly-facing shoulder of a bezel portion of the actuator's housing engages front surface portions of the panel that surround the panel opening, whereupon the actuator's housing is secured in place, often by installing a U-shaped spring clip on portions of the housing located just behind the panel so that the panel is gripped between the rearwardly-facing shoulder which engages the front side of the panel and the spring clip which engages the rear side of the panel.

A drawback of the "from the front" installation approach just described is that, after an actuator assembly has been installed on a panel by inserting rear portions thereof through a panel opening and fastening the actuator assembly to the panel, a second task remains to be completed, namely the task of installing a linkage assembly onto rear portions of the actuator assembly so that a short-distanced forward-rearward movement provided by a push-button-carried cam of the actuator assembly can be converted by the linkage assembly into appropriate other movements of links, triggers or other operating elements of latching and/or locking systems, and the like. Installation of the linkage assemblies of the type disclosed in the referenced Push Button Actuator Patents and in the Push Button Actuator Design Patents onto push button actuator assemblies must take place after the push button actuator assemblies have completed the "from the front" installation procedure because the linkage assemblies are too sizable to pass through the panel openings in which the push button actuator assemblies are installed.

The push button actuator assemblies disclosed in the referenced Push Button Actuator Patents are not designed to have their housings installed using a "from the rear" approach; rather, all are intended to be installed from a front side of the panel—which means that the sizable linkage assemblies that are designed to attach to rear portions of the housings of the push button actuator assemblies cannot be installed on the housings of the push button actuator assemblies until after the actuator assemblies have first been installed in their associated panel openings because these linkage assemblies are too large to pass through the panel openings.

Often, the task of installing an actuator assembly in a panel opening, and the task of installing a linkage assembly onto rear portions of the actuator assembly housing would be simpler and far easier to accomplish if the linkage assembly could be installed onto rear portions of the actuator assembly's housing before the actuator assembly is installed in a panel opening. However, due to the size of the linkage assembly and its inability to pass through the relatively small panel opening in which the actuator assembly is to be installed, this simpler and easier way of doing things can only be employed if the actuator assembly is capable of being installed utilizing a "from the rear" approach—an approach requiring that the actuator housing have a relatively small front portion which can be inserted through the panel opening whereafter it is somehow locked in place and provided with an annular cap, bezel or escutcheon collar that gives the installed unit very much the same sort of neat, clean and attractive appearance that is achieved when the "from the front" approach is used to install an actuator assembly having a housing with an integrally formed bezel that engages front panel surface portions extending about the panel opening.

Attempting to properly install a linkage assembly onto rear portions of a push button actuator housing after the housing has been installed in an opening of a control panel often means that one must couple the linkage assembly to the actuator housing while working in a confined area where nearby components of a delicate nature may be damaged if a tool or one's hand slips as the linkage assembly is being moved into place and securely connected to rear portions of the housing of an actuator assembly. The need for this close-quarter installation work is side-stepped if the linkage assembly can be connected to the actuator assembly before the actuator assembly is installed on a control panel—which is what can be done if the actuator housing can be redesigned to permit its being installed on a panel by inserting front portions of the housing through a panel opening from the rear side of the panel.

While proposals have been made in an effort to provide a variety of panel-mountable devices with the capability of being installed from the rear side of a panel by providing these devices with front housing portions that can be inserted through panel openings and locked in place by affixing bezels or the like to the inserted front housing portions, such proposals have not proven to be suitable for use with the relatively large push button actuator assemblies that are used to operate elements of latching systems installed on industrial tool boxes and industrial cabinets and the like—latching systems that may employ long links that connect with widely spaced latches that need to be operated concurrently—latching systems that may require sizable applications of force to push buttons to effect unlatching—latching systems that may be subjected to a great deal of use and must function reliably throughout lengthy service lives.

SUMMARY OF THE INVENTION

The present invention addresses the needs and drawbacks of the prior art by providing push button actuator assemblies designed to be of rugged, reliable, long-lived construction featuring housings having front portions that can installed in panel openings utilizing a "from the rear" approach—push button actuator assemblies that can have linkage assemblies installed thereon before being installed in panel openings—push button actuator assemblies having front housing portions that are held in place in panel openings by annular caps installed thereon, with the annular caps preferably being held in place by compressed, resilient foam rubber washers that also provide seals between the caps and adjacent front panel surface portions.

Optional features also contemplated by the invention include a set of seal components that may be installed within front passage portions of the housing of an actuator assembly to prevent moisture from penetrating between the push button and the housing of a push button actuator assembly, and a cam that is rigidified against bending that can be mounted on the rear end region of the push button to engage and move a link, trigger or other form of operating element of a latching and/or locking system or the like.

Whereas some of the seals that are employed in prior push button actuator proposals substantially fill an annular space located between the cylindrical outer wall of the push button and the cylindrical interior wall of a housing passage within which the push button translates so as to "wipe" one or the other of these walls as the push button translates relative to the housing, the seal components provided herewith are held in place at the front of the housing passage and engage only a radially extending wall of the push button, so as to not add to the force needed to move the push button relative to the housing.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF PREFERRED EMBODIMENTS

Figure 1:
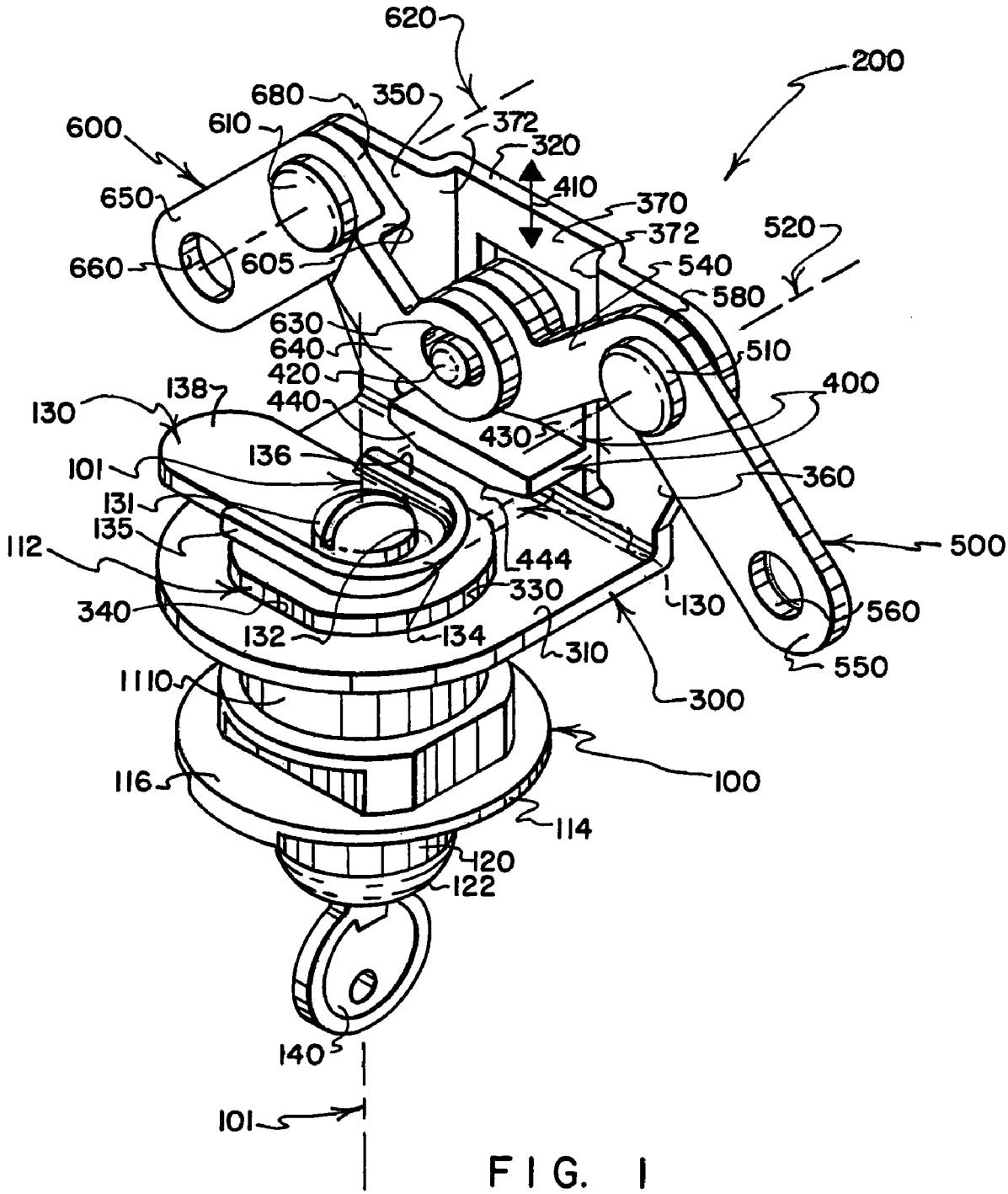
FIG. 1 is a perspective view showing one form of a linkage assembly that can be used with push button actuator assemblies that embody features of the present invention, and showing a known form of push button actuator assembly having an improved, rigidified cam installed thereon for operating the linkage assembly, with solid lines showing the cam in a locked position, with broken lines showing the cam in an unlocked position, and with components of the linkage assembly in normal, non-operated positions.

Referring to FIG. 1, a push button actuator assembly 100 having a generally cylindrical housing 110 is shown with a dual-arm linkage assembly 200 mounted on a rear end region 112 of the housing 110. The push button assembly 100 has a push button 120 that is shown in its normal, forwardly projecting, non-operated position. The push button 120 extends through the housing 110 to support an actuator cam 130 at its rear. The actuator cam 130 moves forwardly and rearwardly with the push button 120. Additionally, the actuator cam 130 can be turned between a locked position (shown by solid lines in FIG. 1) and an unlocked position (shown by broken lines in FIG. 1) by turning a correctly configured key 140 inserted into a keyway (not shown) that opens through a front face 122 of the push button 120.

If the push button 120 is depressed while the actuator cam 130 is in the locked position (the locked position of the cam 130 is shown by solid lines in FIG. 1), the cam 130 will not cause either of the pivotal arms 500, 600 of the dual-arm linkage assembly 200 to move out of their normal, non-operated positions (the normal, non-operated positions of the arms 500, 600 are shown in FIG. 1). If, however, the push button 120 is depressed while the actuator cam 130 is in the unlocked position, a rounded outer end region 138 of the cam 130 (which is caused to extend in front of a front end region 444 of a slide 400 when the cam 130 is pivoted from the locked position shown by solid lines in FIG. 1 to the unlocked position (shown by broken lines in FIG. 1) will move rearwardly with the push button 120 to engage the front end region 444 and to cause the slide 400 to move rearwardly along a path of travel indicated by an arrow 410 to concurrently pivot the arms 500, 600 from the non-operated positions depicted in FIG. 1 to the operated positions shown in FIG. 2.

Figure 2:
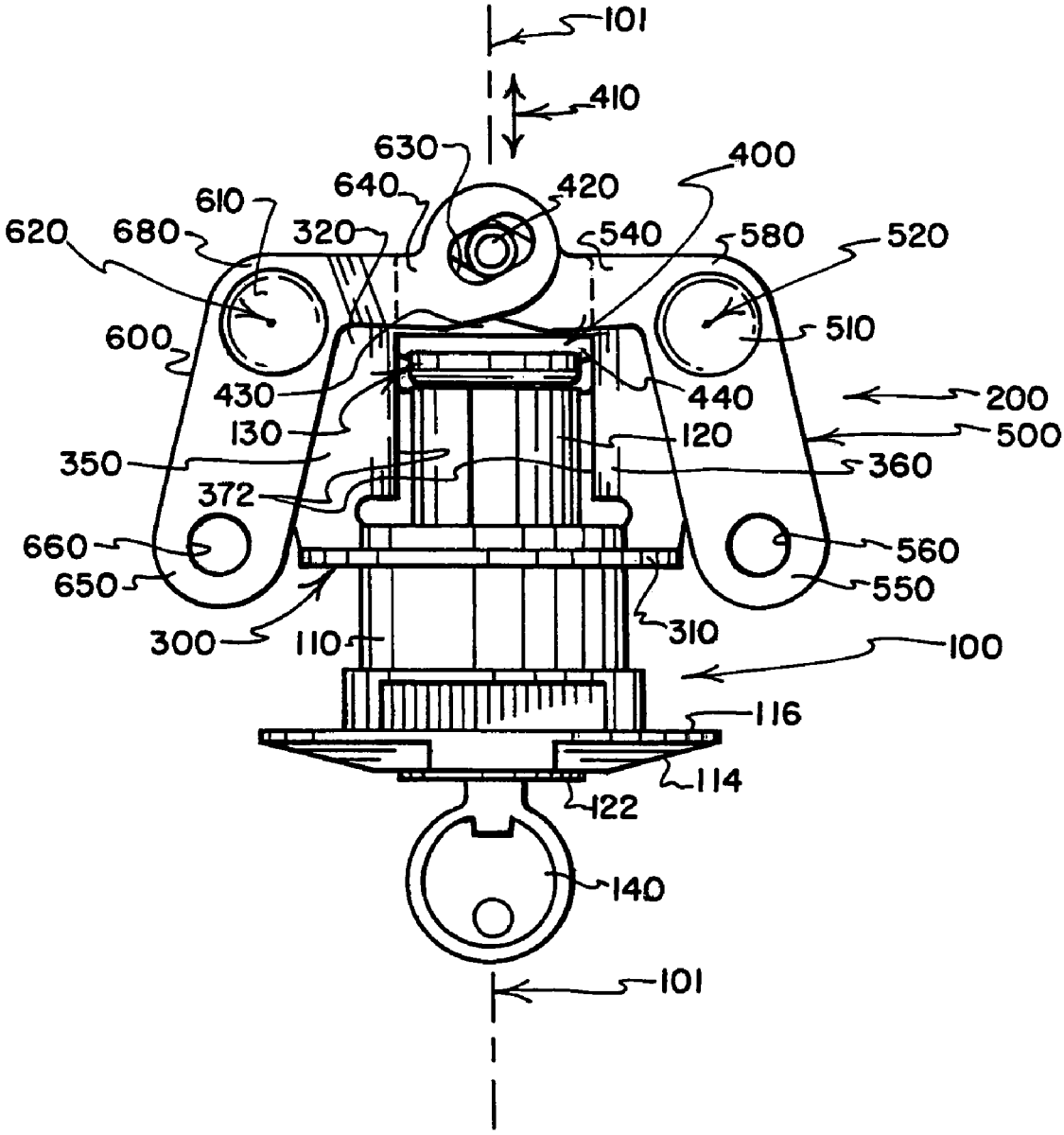
FIG. 2 is a side view thereof but with the cam in the unlocked position, and with the push button and components of the linkage assembly in operated positions.

With the exception of the configuration of the cam 130, the push button actuator assembly 100 and the dual-arm linkage assembly 200 shown in FIGS. 1 and 2 are identical in all respects to a push button actuator assembly 100 and a dual-arm linkage assembly 200 that are disclosed and described in the last-listed of the above-referenced Push Button Actuator Patents. Inasmuch as all elements of the assemblies 100, 200 are disclosed and described in detail in the last-listed of the above-referenced Push Button Actuator Patents, features of the assemblies 100, 200 (other than features of the improved cam 130) need be only briefly described here.

Should the reader desire additional information on actuator and linkage assemblies with which the improved actuator cam 130 and other elements of the present invention may be put to use, reference also is made to U.S. Pat. No. 6,231,091 issued May 15, 2001 to Gleason et al (a patent of Tri/Mark Corporation) which discloses somewhat different forms of push button actuator and dual-arm linkage assemblies together with examples of latch and lock systems wherein assemblies of this general type may be put to use.

Referring to FIGS. 1 and 2, the housing 110 of the actuator assembly 100 has a front bezel 114 of relatively large diameter provided with a rearwardly facing shoulder 116. The shoulder 116 is relatively flat and extends in a plane that is perpendicular to a central axis 101 of the housing 110—a forwardly-rearwardly extending axis that extends centrally through a forwardly-rearwardly extending passage (not shown) defined by the housing 110 wherein the push button 120 is translatably carried for movement between the normal, forwardly-projecting position shown in FIG. 1 and the depressed, rearwardly-projecting position shown in FIG. 2.

When the push button actuator assembly 100 is to be mounted in an opening of a control panel or the like (not shown), portions of the housing 110 located to the rear of the front bezel 114 are inserted through the panel opening (from the front side of the panel), and the flat, rearwardly-facing shoulder 116 is brought to a position of overlying engagement with front surface portions of the panel located in surrounding relationship to the panel opening; or, if desired, a resilient annular seal (not shown—typically a flat rubber washer) is installed on rear portions of the housing 110 and is compressed between the rearwardly-facing shoulder 116 and such front surface portions of the panel as surround the panel opening to seal the opening and prevent the passage of moisture therethrough.

The linkage assembly 200 includes a generally L-shaped frame 300 (best seen in FIG. 1) having a support leg 310 and a component mounting leg 320. The slide 400 is carried by the component mounting leg 320 of the frame for translation along the travel path 410 between the normal position of the slide 400 shown in FIG. 1 and the operated position of the slide 400 shown in FIG. 2. The arms 500, 600 are pivotally connected to opposite side portions 350, 360 of the component mounting leg 320 of the frame 300 by rivets 510, 610, respectively, for pivotal movement between the normal position shown in FIG. 1 and the operated position shown in FIG. 2 as the slide 400 moves in a coordinated manner between the positions of FIGS. 1 and 2. Movement of the arms 500, 600 is coordinated by an elongate, pin-like formation 420 of the slide 400 that extends through aligned openings (one of which is indicated by the numeral 630 in FIG. 1) formed through overlying inner end regions 540, 640 of the arms 500, 600.

Outer end regions 550, 650 of the arms 500, 600 are provided with connection holes 560, 660, respectively, that can be used to connect with latch operating links (not shown). Latches (not shown) that are operated by links connected to the outer end regions 550, 650 of the arms 500, 600 can be of a wide variety of types, such as are disclosed in the Eberhard and Tri/Mark utility patents identified above.

Referring to FIG. 1, the L-shaped frame 300 has a relatively large opening 330 which extends through the support leg 310 to receive the rear end region 112 of the housing 110 of a push button assembly 100. The opening 330 may be provided with one or a pair of opposed flat surface portions (one of which is indicated by the numeral 340 in FIG. 1) of the support leg 310 to engage one or a pair of corresponding flat surface portions of the housing 110 of the push button assembly 100 to prevent the frame 300 from rotating on the housing 110 (or the end region 112 may be provided with mounting groove portions as indicated by the numeral 510 in FIGS. 10 and 12 to receive clamp-on elements of the type disclosed in several of the referenced Eberhard patents) to hold the support leg 310 in place on the housing 110. Alternatively the support leg 310 may be held in place on the housing 110 of a push button assembly 100 by a simple U-shaped spring clip of the type depicted in the aforementioned Tri/Mark patent, or by other suitable mounting means.

Referring to FIG. 1, the component mounting leg 320 of the L-shaped frame 300 has a depressed or offset central portion 370 (that extends alongside a path of travel 410 followed by the slide 400) which is located between opposite side portions 350, 360 of the component mounting leg 320. Opposed curved wall portions 372 connect the depressed central portion 370 with the opposed side portions 350, 360 of the component mounting leg 320. Holes (not shown) formed through the opposed side portions 350, 360 receive the rivets 510, 610 that extend through holes (not shown) formed through central portions 580, 680 of the arms 500, 600 to establish pivotal connections between the L-shaped frame 300 and the arms 500, 600 that permit the arms 500, 600 to pivot relative to the frame 300 about substantially parallel extending axes 520, 620 of the rivets 510, 610.

The slide 400 has a relatively flat central portion 430 that moves along the travel path 410 when the slide 400 is moved rearwardly by the cam 130 in response to depression of the unlocked push button 120. Extending away from one side of the flat central portion 430 are the pin formation 420 and an abutment formation 440 having a front surface 444 that is engaged by the actuator cam 130 of the push button assembly 100 when the actuator cam 130 has been rotated to the unlocked position (shown by broken lines in FIG. 1) and when the actuator cam 130 has been moved rearwardly (while in the unlocked position) by the push button actuator 110 (as shown in FIG. 2). Opposed end regions of the surface 444 are inclined slightly relative to a plane in which central portions of the surface 444 extend, to aid in guiding the actuator cam 130 into engagement with the central portions of the surface 444 when the cam 130 is rotated from its locked position (out of engagement with the surface 444) to its unlocked position (extending along the front side of the surface 444 so as to be moved into engagement with the surface 444 when the push button 120 is depressed).

Referring to FIG. 1, although the arm 500 is substantially flat, the arm 600 is not: indeed, the arm 600 has an offset or dogleg 605 located between its central region 680 and its inner end region 640. The arms 500, 600 pivot in a coordinated and "in unison" manner so that oppositely extending links connected to the outer end regions 550, 650 of the arms 500, 600 will be moved through equal distances when the arms 500, 600 pivot in response to translation of the slide 400 along its path of travel 410.

The actuator cam 130 is what causes the slide 400 to move along the travel path 410 to pivot the arms 500, 600 from their normal positions shown in FIG. 1 to their operated positions shown in FIG. 2. To rigidify the cam 130 to ensure that it will not bend when called upon to push the slide 400 rearwardly (in response to the cam 130 being moved rearwardly as the push button 120 is depressed), the flat, rounded inner end region 132 of the cam 130 is provided with an extended, integrally formed edge region 134 that is bent or turned out of the plane of the flat, rounded inner end region 132.

Referring to FIGS. 3-8, the rounded, rearwardly turned edge region 134 preferably extends in a semi-circular fashion about the semi-circular rounded flat inner end region 132 of the cam 130. To add stiffness and rigidification to the cam 130, the edge region 134 (which is turned out of the plane of the flat inner end region 132) may be contiguously extended in an uninterrupted manner for selected distances along the spaced, substantially parallel-extending sides of the cam 130 as is indicated by the numerals 135, 136. The extensions 135, 136 of the rolled-over edge region 134 may extend as far along opposite sides of the cam 130 as is desired, and may be of unequal length if, for example, one of the extensions 135, 136 should be shorter than the other to minimize the possibility of extension contact or impact with structure found near the installed push button actuator assembly 100.

Figure 3:
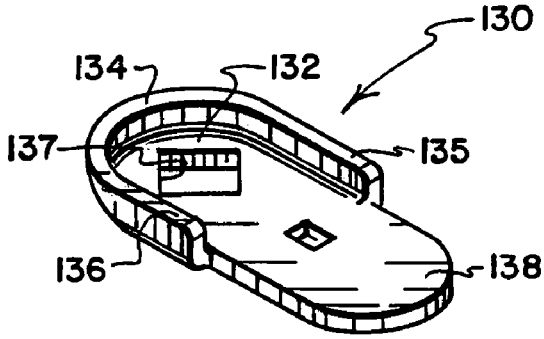
FIG. 3 is a perspective view of the rigidified cam.
Figure 7:
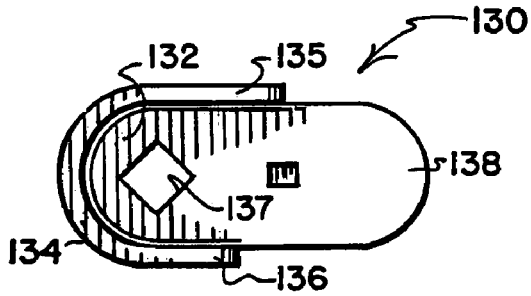
FIG. 7 is a top plan view of the cam.
Figure 8:
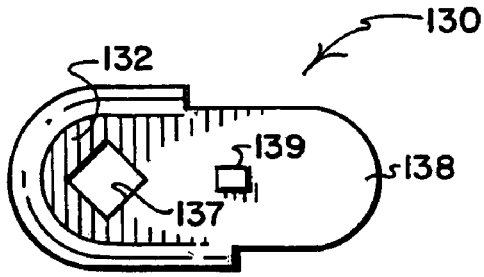
FIG. 8 is a bottom plan view of the cam.

Referring to FIGS. 3, 7 and 8, the flat inner end region 132 of the cam 130 is provided with a square opening 137 formed therethrough that is used to mount the cam 130 on a correspondingly configured projection (not shown) of the rear end region of the push button 120. A threaded fastener 131 (having an enlarged head that is of sufficient size to enable the periphery of the head to overlie and clamp against portions of the flat inner end region 132 that extend about the square opening 137) is used to hold the cam 130 in place on the rear end region of the push button 120 by extending through the square opening and by being threaded into a threaded hole (not shown) formed in the rear end region of the push button 120).

Figure 9:
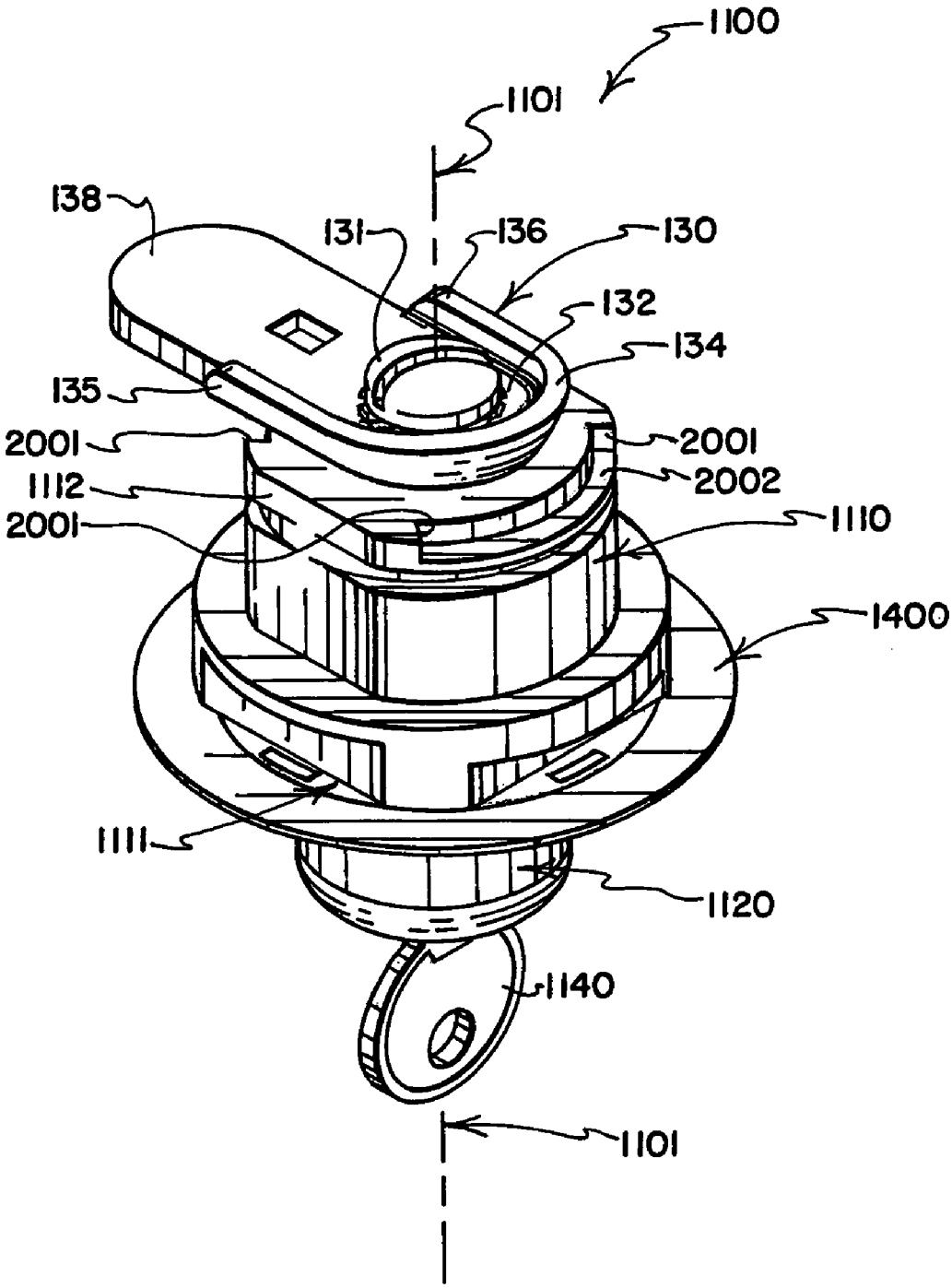
FIG. 9 is a perspective view showing an improved form of push button actuator assembly embodying features of the preferred practice of the present invention with an annular cap installed on front portions of a housing of the actuator assembly.

The cam 130 as depicted in FIGS. 3-9 (but not as it is depicted in FIG. 1) may optionally be provided with an integrally formed projection 139 that extends out of the plane of the flat inner end region 132. In preferred practice, the projection 139 is formed in a stamping operation by displacing material from a central part of the cam 130 so that a dimple is formed in the side of the cam 130 opposite from the projection 139. Referring to FIG. 9, the projection 139 is preferably configured to ride in one of a pair of curved grooves 2002 (best shown in FIG. 10) that may optionally be provided in the rear end region 1112 of a housing 1110 of a push button actuator assembly 1100, and preferably is positioned so as to engage one or the other of a pair of stop surfaces 2001 that are provided at opposite ends of each of the grooves 2002 when the cam 130 is at one or the other of the ends of its range of travel (i.e., when the cam 130 is in one or the other of its locked and unlocked positions). The grooves 2002 have lengths that cause the projection 139 to engage one of the stop surfaces 2001 after each quarter turn of the cam 130 (i.e., the cam 130 is permitted by the interaction of the projection 139 with a pair of the stop surfaces 2001 to turn only about a quarter turn in moving between its locked and unlocked positions).

Although the interaction of the projection 139 with the stop surfaces 2001 can and normally does serve to limit the angular rotation of the cam 130, this range limiting action merely supplements the operation of other components normally found on push button actuator assemblies of the type disclosed in the referenced Eberhard and Tri/Mark utility patents. This supplementation is desirable due to the heavy use to which these actuator assemblies often are put during lengthy service lives, and helps to relieve forces applied to more delicate range limiting components found on these assemblies (see, for example, the washer 900 shown in FIG. 10 which has a notched periphery 901 that cooperates with a projection 902 carried on a push button member 1120, the operation of which is discussed in Eberhard's U.S. Pat. No. 6,755,449 should the reader desire more information with respect thereto).

Since a push button on which the cam 130 is mounted is biased toward and therefore almost always is in its normal, forwardly extended position (as depicted, for example, in FIG. 9), the projection 139 of the cam 130 almost always resides in one of the grooves 2002 and almost always engages one of the stop surfaces 2001 when the cam 130 is turned to one of its locked and unlocked positions. However, when the push button 1120 is depressed, the cam 130 moves rearwardly with the push button 1120—which takes the projection 139 away from the rear end region of the housing and away from the grooves 2002. If the depressed push button 1120 is turned between its locked and unlocked positions at a time when the cam projection 139 is not received in one of the grooves 2002, the cam projection 139 cannot cooperate with the stop surfaces 2001 to supplement the angular rotation limiting action of other components of the push button actuator assembly, and the role of limiting the turning range of the cam 130 to a quarter turn is left exclusively to the purview of other components of the actuator assembly.

The push button actuator assembly 1100 depicted in FIG. 9 embodies more features of the preferred practice of the present invention than are found in the push button actuator assembly 100 shown in FIGS. 1-2. Features of the push button actuator assembly 1100 will now be described so that differences between the actuator assemblies 100, 1100 can be appreciated.

Referring to FIG. 9, the push button actuator assembly 1100 has a push button 1120 that can translate along an axis 1101 that extends centrally through a generally cylindrical housing 1110. The cam 130 of the actuator assembly 1100 moves forwardly and rearwardly with the push button 1120, and can be turned between locked and unlocked positions (just as has been described in conjunction with the cam 130 of the actuator assembly 100) by turning a correctly configured key 1140 that has been inserted in a keyway (not shown) that opens through the front end of the push button 1120. The push button 1120 actually is an assembly of many components—components that include a lock cylinder with tumblers that interact with the key 1140 in a conventional manner as described in the referenced Eberhard U.S. Pat. No. 6,755,449—that enable the cam 130 to turn between its locked and unlocked positions (as depicted in solid and broken lines in FIG. 1), and that serve to retain the cam 130 in one or the other of its locked and unlocked positions when the key 1140 is removed from the push button 1140.

Figure 4:
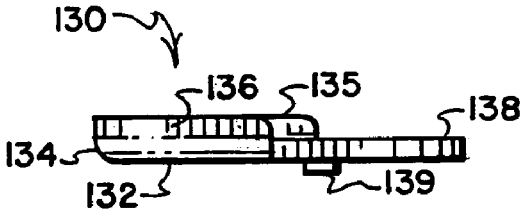
FIG. 4 is a front view of the cam.
Figure 5:
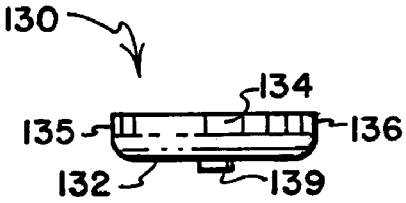
FIG. 5 is a left end view of the cam.
Figure 6:
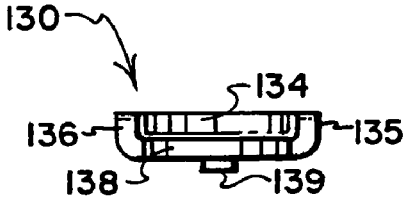
FIG. 6 is a right end view of the cam.
Figure 12:
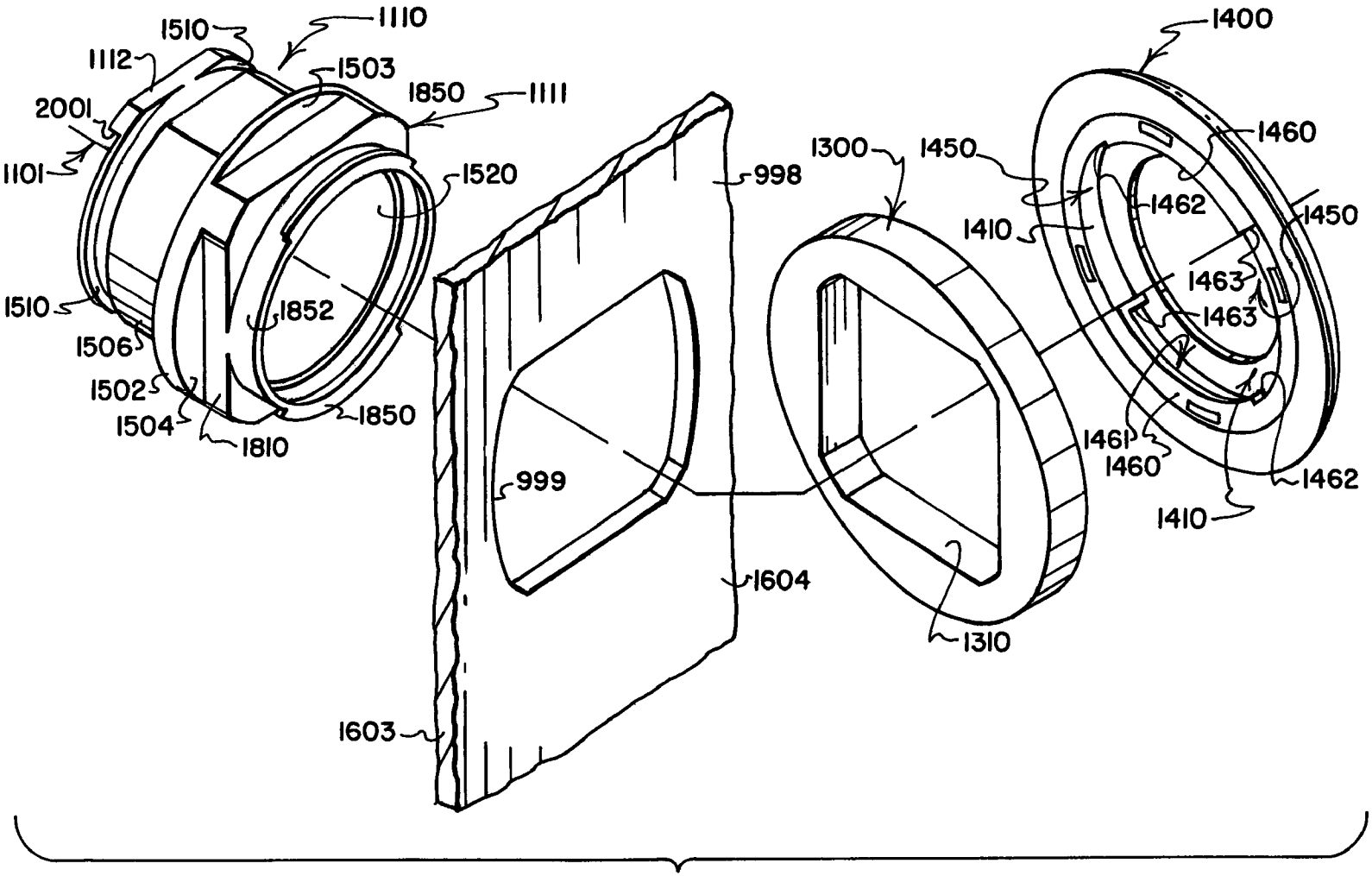
FIG. 12 is an exploded perspective view showing front portions of the housing of the actuator assembly, a panel portion having an opening through which the front portions of the housing may be inserted, and elements of the actuator assembly used to hold the housing in an installed position in the panel opening including a resilient foam rubber washer and an annular cap.

Exterior features of the push button actuator assembly 1100 that differ from exterior features of the actuator assembly 100 include the previously described grooves or notches 2002 that are provided on the rear end region 1112 of the housing 1110 (that, at opposite ends thereof, define the stop surfaces 2001, two of which interact with the cam projection 139 shown in FIGS. 4-6 to limit the turning of the cam to approximately a quarter turn relative to the housing 1110). Referring to FIG. 12, exterior features of the actuator assembly 1100 that differ from exterior features of the actuator assembly 100 also include a front portion 1111 of the housing 1110 that is designed 1) to be inserted from the rear of a panel 998 through a panel opening 999, 2) to have a resilient foam rubber washer 1300 installed thereon, and 3) to connect with an annular front cap 1400 that can be removably installed on the housing 1110 in a manner that permits the biasing action of the washer 1300, when compressed, to hold the cap 1400 securely in place on the housing 1110.

What the front portion 1111 of the housing 1110, the resilient foam rubber washer 1300 and the annular front cap 1400 render possible is for a linkage assembly (such as the linkage assembly 200 shown in FIGS. 1-2, or other linkage assemblies such as are shown in the referenced Eberhard and Tri/Mark patents) to be installed on the housing 1110 before the front portion 1111 of the housing 1110 is inserted through the opening 999 of the panel 998 and locked in place by the washer 1300 and the cap 1400. The "from the rear" mounting approach that is used to mount the push button actuator assembly 1100 in a panel opening is quite unlike the "from the front" mounting approach that is used to mount the push button actuator assembly 100 in a panel opening.

Before discussing how the forward end region 1111 of the housing 1110, the washer 1300 and the cap 1400 are utilized to hold the housing 1110 in place in a panel opening, features of the internal components of the push button actuator 1110 will be described so the reader can understand how an improved seal preferably is provided between the push button actuator 1120 and the housing 1110 that eliminates the frictional drag of a seal on the push button 1120 that could add to the force needed to move the push button 1120 relative to the housing 1110, which has proved to be a problem with some prior push button actuator proposals.

Figure 10:
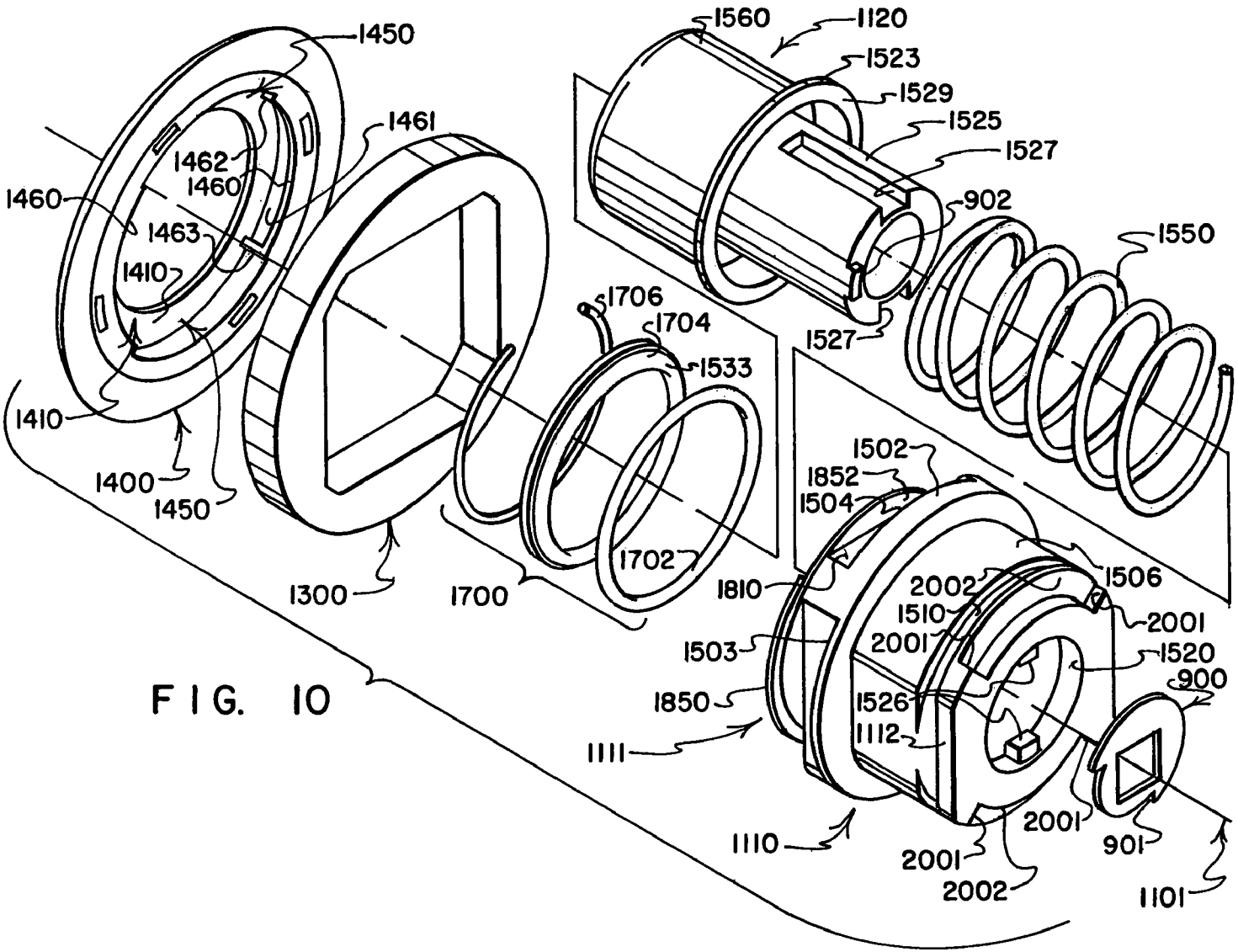
FIG. 10 is an exploded perspective view showing features of selected components of the push button actuator assembly of FIG. 9, including three elements that are installed inside a front end region of a passage formed centrally through the housing of the push button actuator assembly of FIG. 9 to seal between the housing and a smooth outer surface of a push button element of the actuator assembly.
Figure 13:
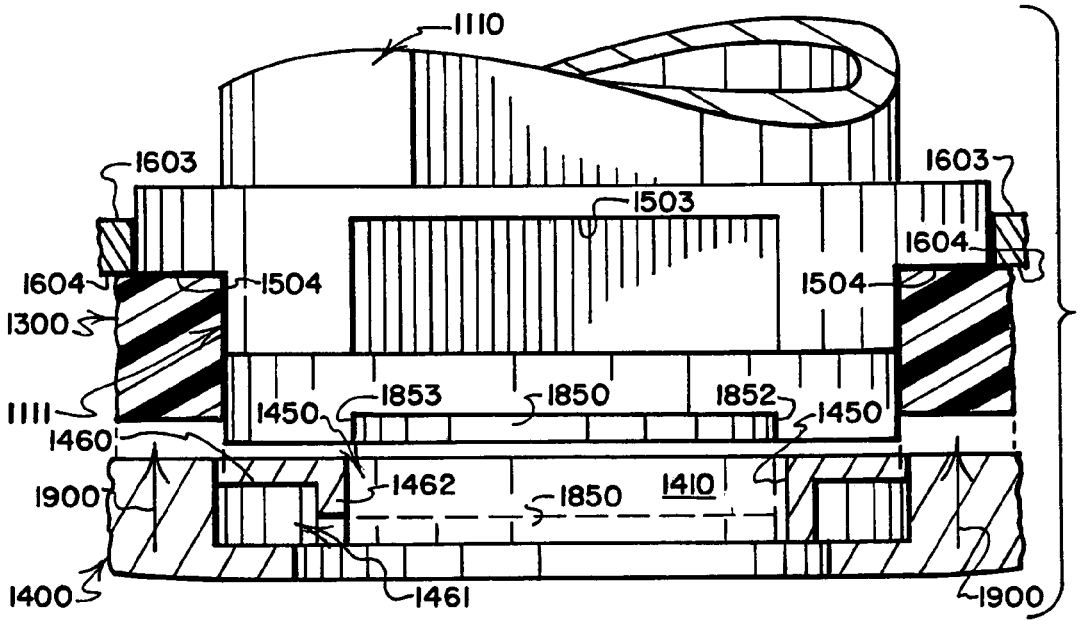
FIG. 13 is a somewhat schematic view showing one side of a front portion of the housing of the actuator assembly inserted through a panel opening, showing in cross-section interior portions of the annular cap as the cap is moved rearwardly toward the housing in a direction indicated by an arrow during a procedure that connects the cap to the housing, showing in cross-section portions of a resilient foam rubber washer in their normal, uncompressed configuration, and showing a radially extending formation of the housing aligned with a rearwardly opening passage defined by the cap.
Figure 14:
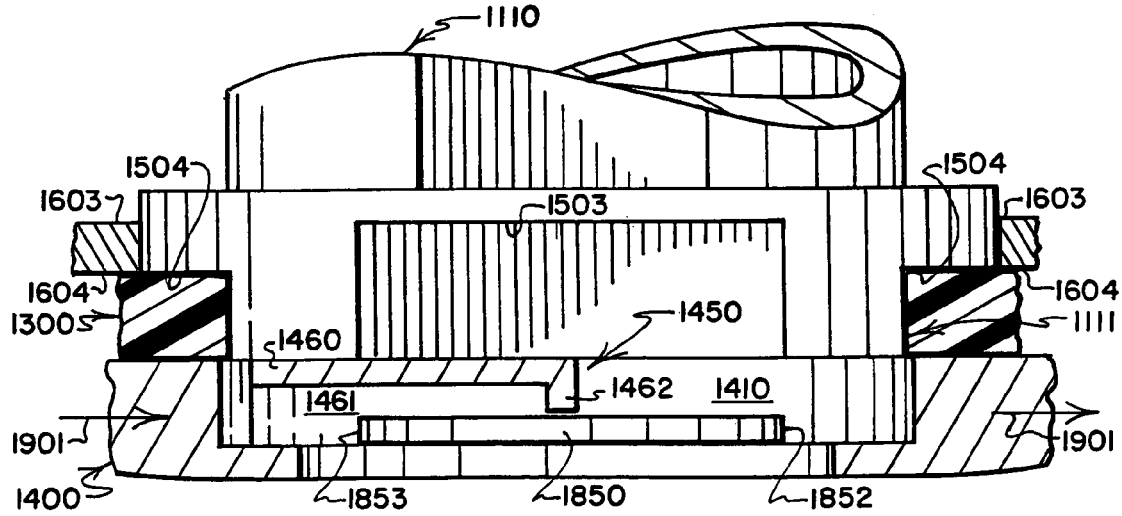
FIG. 14 is a view similar to FIG. 13 with the cap moved into engagement with the housing and turned slightly relative to the housing in a direction indicated by arrows during the procedure that connects the cap to the housing, it being noted that the resilient foam rubber washer is severely compressed between the panel and the cap and that the radially extending formation of the housing has moved into a circumferentially extending passage of the cap after being received in the rearwardly opening passage defined by the cap.
Figure 15:
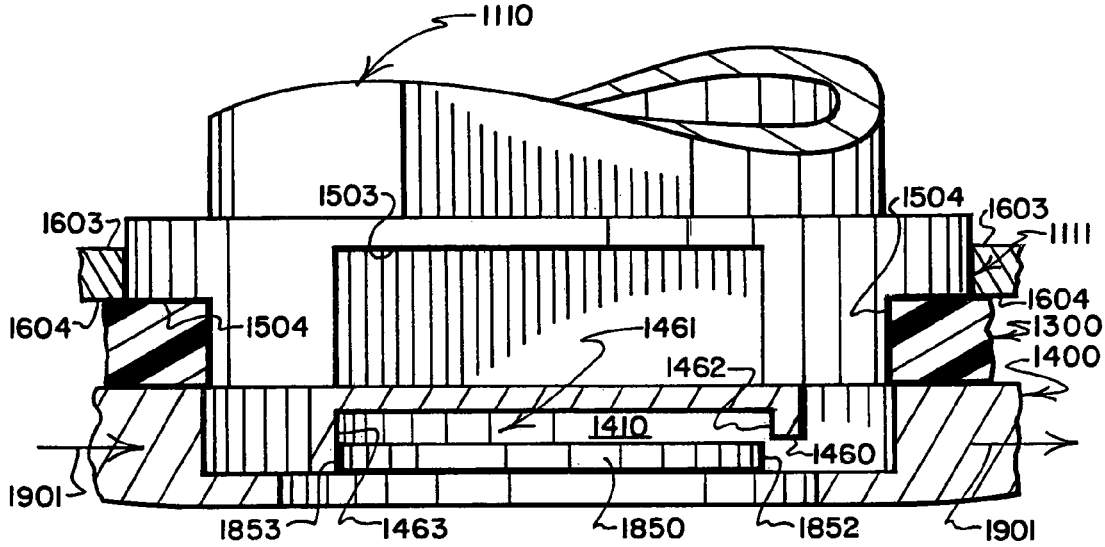
FIG. 15 is a view similar to FIGS. 13 and 14 with the cap turned even more in the direction indicated by an arrow during the procedure that connects the cap to the housing, it being noted that the washer is in substantially the same state of severe compression as is shown in FIG. 13 and that the radially extending formation of the housing has moved through the circumferentially extending passage to align with a forwardly extending chamber defined by the cap; and, FIG. 16 is a view similar to FIGS. 13-15 with the cap moved forwardly under the biasing action of the washer which is in a slightly less compressed state than is depicted in FIGS. 14-15, it being seen that the the radially extending formation of the housing has moved into the forwardly extending chamber of the cap and that side walls of the chamber prevent the cap from rotating relative to the housing so that the cap cannot rotate relative to the housing and therefore will remain in place on the housing unless and until the cap is moved to compress the washer to the state shown in FIG. 15 at which time the cap can be rotated in a direction opposite to that indicated by the arrows in FIGS. 14-15 to reverse the steps of the installation procedure to remove the cap from the housing.

Referring to FIGS. 10 and 12, the push button operator assembly 1100 includes the generally cylindrical housing 1110 which has a relatively large diameter, circumferentially extending surface 1502, front portions of which are cut away as indicated by numerals 1503, 1504. What the numerals 1503, 1504 designate are forwardly facing surfaces that extend in different but closely spaced planes that perpendicularly intersect a central axis 1101 of the housing 1110. When the housing 1110 is installed on the panel 998 shown in FIG. 12 (as is depicted in FIGS. 13-15), two of the forwardly facing surfaces 1503 (only one of which is shown in FIGS. 13-15) extend in the same plane as and engage the back surface 1603 of the panel 998 at locations on opposite sides of the panel opening 999, and two of the forwardly facing surfaces 1504 (both of which are shown in FIGS. 13-15) reside in substantially the same plane as the front surface 1604 of the panel 998 so as to be engaged by a rear surface of the washer 1300 at locations on opposite sides of the panel opening 999.

Whether the housing surfaces 1504 extend in precisely the same plane as the front surface 1604 of the panel 998 depends on whether the panel 998 has a thickness that is exactly the same as the spacing between the planes of the housing surfaces 1503, 1504. The housing surfaces 1504 will be situated slightly forwardly from the front surface 1604 of a panel 998 that is slightly thinner than the spacing of the planes of the surfaces 1503, 1504. The housing surfaces 1504 will be situated slightly rearwardly from the front surface 1604 of a panel 998 that is slightly thicker than the spacing of the planes of the surfaces 1503, 1504.

Referring to FIGS. 10 and 12, the housing 1110 has a generally cylindrical central portion 1506 that extends rearwardly from where the surface 1502 encircles the largest diameter portion of the housing 1110, and has a rear portion 1112 that defines circumferentially extending groove portions 1510 that can be engaged by a U-shaped spring clip (not shown, but typically of the type disclosed in the referenced Tri/Mark patent) or by clamp-on elements of a support leg of an L-shaped frame (not shown, but preferably of the type disclosed in several of the referenced Push Button Actuator Design Patents) of such linkage assemblies as are disclosed in several of the referenced Tri/Mark and Eberhard patents to mount a selected one of these linkage assemblies or the like on the housing 1110 to be operated by the cam 130 in substantially the same manner as the cam 130 of the actuator assembly 100 operates the linkage assembly 200.

Figure 11:
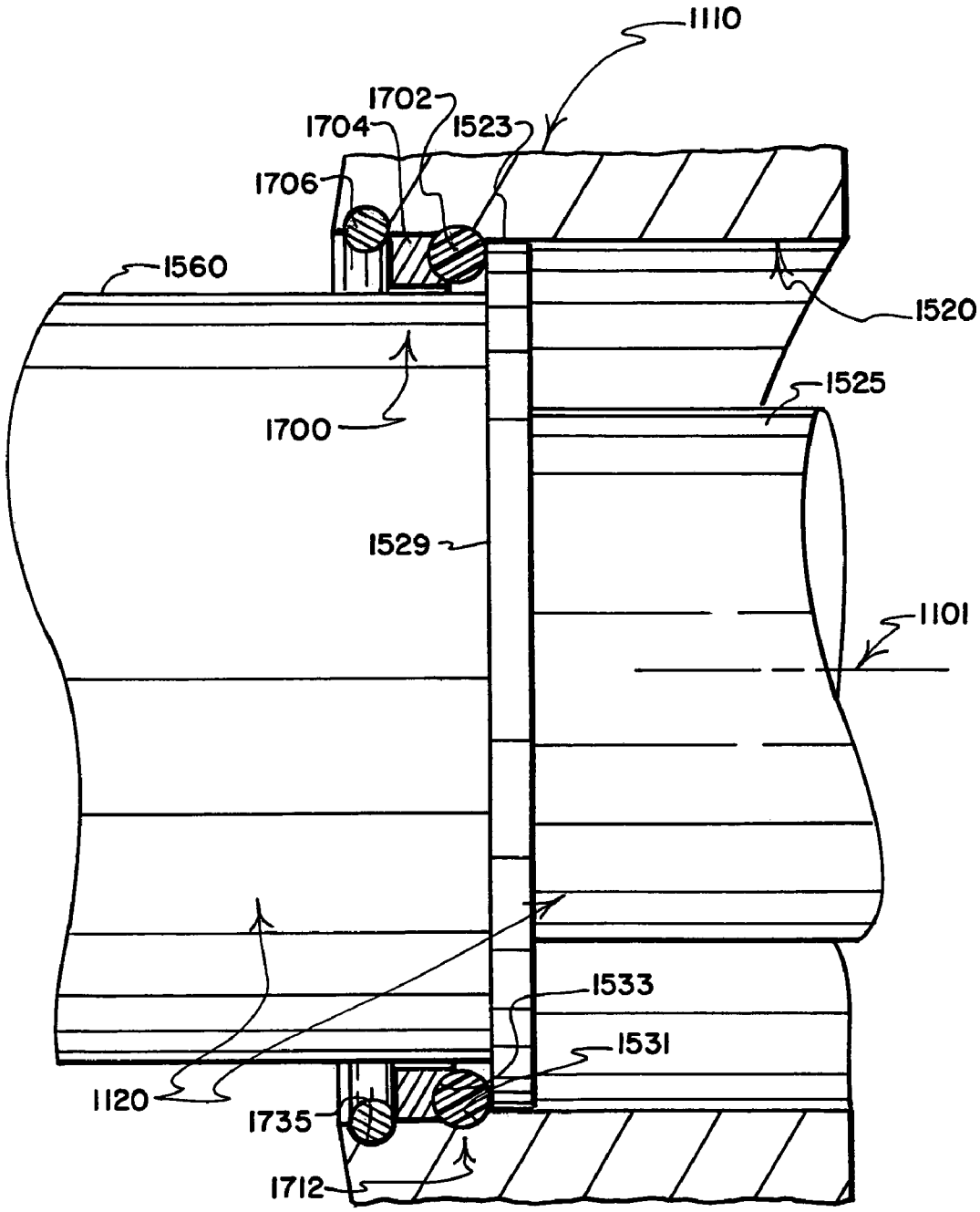
FIG. 11 is a cross-sectional view, on an enlarged scale, showing portions of the housing and the push button and seal elements interposed therebetween in the push button actuator assembly of FIG. 9.

Referring to FIGS. 10-12, the housing 1110 has a central passage 1520 extending therethrough along the axis 1101 and opens through the forward and rearward end regions of the housing 1110. A front end region of the passage 1520 is sized to loosely receive a largest diameter portion 1523 (see FIGS. 10 and 11) of the push button 1120. A rear end region of the passage 1520 is sized to loosely receive a smaller diameter rear end region 1525 (see FIGS. 10 and 11) of the push button 1220. Referring to FIG. 10, a pair of projections 1526 of the housing 1110 extend into the rear end region of the passage 1520 and are configured to extend into grooves 1527 that extend forwardly-rearwardly along opposite sides of the smaller diameter rear end region 1525 of the push button 1120.

Not shown in the drawings hereof is a key cylinder assembly that comprises an internal component of the push button 1120—a component that is described in the referenced Eberhard U.S. Pat. No. 6,755,449—a key cylinder plug component that moves forwardly and rearwardly with the depicted push button component 1120, but which can turn relative to the housing 1110 about the axis 1101 to turn the cam 130 that is secured to the rear end region thereof by the threaded fastener 131. A similar key cylinder plug component also is disclosed in the referenced Tri/Mark patent, should the reader desire additional detail with respect thereto.

Referring to FIG. 10, a compression coil spring 1550 is interposed between the push button 1120 and the housing 1110 to bias the push button 1120 forwardly toward the normal, forwardly extended position shown in FIG. 9 (it being understood that the push button actuator assembly 100 also includes such a spring to bias its push button 120 forwardly toward the normal, forwardly extended position shown in FIG. 1 hereof). When the push button 1120 is depressed to move the cam 130 rearwardly (for example in the manner depicted in FIG. 2 hereof), the spring 1550 is compressed within the confines of the housing 1110.

Referring to FIGS. 10 and 11, the push button 1120 has a generally cylindrical front region bounded by a smooth, cylindrical outer surface 1560. To prevent moisture from traveling rearwardly through the passage 1520 between the push button 1120 and the housing 1110, a seal assembly 1700 is provided that consists of three elements, namely an O-ring 1702, a retainer disc 1704, and a wire-form snap ring 1706.

Referring to FIG. 11, the O-ring 1702 is installed in the housing passage 1520 at a location indicated by the numeral 1712 where the O-ring is prevented by the configuration of the passage 1520 from moving farther rearwardly within the passage. At the location 1712, the passage 1520 either is provided with a shallow, rounded-bottom groove 1531 that opens inwardly into the passage 1520 so as to receive outer portions of the O-ring 1702, or the passage 1520 changes from a larger front diameter to a smaller rear diameter, or both—to prevent rearward movement of the O-ring 1702 from the location 1712. The O-ring 1702 has an inner diameter that is larger than the diameter of the surface 1560 of the push button so as to not "wipe" or drag on the surface 1560 as the push button 1120 moves forwardly and rearwardly within the passage 1520 of the housing 1110. The size of the O-ring 1702 is selected so that, when a forwardly-facing shoulder 1529 of the push button 1120 (the shoulder 1529 extends radially to join the smaller diameter surface 1560 with the larger diameter surface 1523) moves into engagement with the O-ring 1702, a seal will be established between the push button 1120 and the housing 1110 that will prevent moisture from traveling rearwardly through the passage 1520.

The retaining disc 1704 has an outer diameter that permits the disc 1704 to be inserted in a close fit into a front portion of the passage 1520, and an inner diameter that is larger than the diameter of the surface 1560 so the disc 1704 does not frictionally drag on the surface 1560 as the push button 1120 moves within the housing passage 1520. The disc 1704 also has a curved rear face 1533 that engages the curved front surface of the O-ring 1702 to hold the O-ring 1702 in place in the passage 1520 when the shoulder 1529 of the push button 1120 presses against the O-ring 1702 due to the action of the spring 1550 (FIG. 10) on the push button 1120.

The snap ring 1706 normally has a diameter greater than is depicted in FIG. 11, and thus holds itself in place when it is compressed and inserted into the passage 5120 where it is received within a rounded-bottom groove 1735. The groove 1735 positions the snap ring 1706 to engage and hold in position the retaining disc 1704, by which arrangement the retaining disc 1704 and the O-ring 1702 are held in place within the passage 1520. Inasmuch as none of the components 1702, 1704, 1706 drags on or otherwise frictionally engages the surface 1560 of the push button 1120 as the push button 1120 moves back and forth in the passage 1520, the three-element seal assembly 1700 provided by the components 1702, 1704, 1706 unquestionably avoids a drawback found in seals utilized in many prior push button assembly proposals where push button movement was inhibited or rendered more difficult by the presence of seals that "wiped" or dragged along push button surfaces as the push buttons moved within housing defined passages of the push button assemblies.

Referring to FIG. 12, the front portion 1111 of the housing 1110 that is configured to be inserted from the rear of the panel 998 through the panel opening 999 includes a substantially square formation 1810 that is mimicked by the shape of a substantially square opening 1310 formed through the resilient foam rubber washer 1300. The opening 1310 of the washer 1300 is sized to permit the washer 1300 to be installed easily onto the square formation 1810 of the housing 1110 at a location in front of the panel 998 and behind the annular cap 1400. The outer diameter of the washer 1300 is selected to provide enough resilient foam rubber material to establish a seal between the panel 998 and the cap 1400 without permitting the material of the washer 1300 to extend radially beyond the outer diameter of the cap 1400 when the washer 1300 is compressed by being clamped between the panel 998 and the cap 1400.

Referring still to FIG. 12, the front portion 1111 of the housing 1110 has a pair of opposed, radially extending, arcuate formations 1850 that project radially outwardly from a generally cylindrical surface 1852. The cap 1400 has a rearwardly facing recess 1410 that provides opposed, rearwardly facing openings 1450 configured to receive the arcuate formations 1850 of the housing 1110, and has a pair of identically configured, circumferentially curved walls 1460 that extend radially into the recess 1410 at locations between the openings 1450. The curved walls 1460 have an inner diameter slightly larger than the outer diameter of the housing surface 1852.

The curved walls 1460 overlie curved, circumferentially extending segments 1461 of the recess 1410 into which the radially extending formations 1850 of the housing 1110 can be inserted as by turning the cap 1400 about the axis 1101 relative to the housing 1110 at a time after the radially extending formations 1850 have been inserted as deeply as possible into the openings 1450 of the recess 1410. And, as will be explained in the discussion of FIGS. 13-15 that follows, short and long axially extending walls 1462, 1463 (which join with the curved walls 1460 at opposite ends of the curved walls 1460) are provided at opposite ends of the curved, circumferentially extending segments 1461 of the recess 1410—axially extending walls that can engage opposite ends of the radially extending formations 1850 to retain the radially extending formations 1850 within the circumferentially extending segments 1461 of the recess 1410 in a manner that serves to lock the cap 1400 onto the housing 1100.

To better understand what is stated in the paragraph just above, reference is made to FIG. 13 where portions of the cap 1400 are shown spaced from the front portion 1111 of the housing 1110. As the cap 1400 moves rearwardly toward the housing 1110 in a direction indicated by arrows 1900, it will be seen that one of the radially extending formations 1850 is aligned with and can move into one of the openings 1450 of the cap 1400. After the radially extending formation 1850 moves as deeply as possible through the opening 1450 into the recess 1410, the radially extending formation 1850 is in the position depicted in FIG. 13 by broken lines.

Because opposite sides of the housing 1110 and opposite sides of the cap 1400 are identically configured, those who are skilled in the art will readily understand that what is depicted in FIGS. 13-15 shows only half of what happens as the cap 1400 is being installed on the front portion 1111 of the housing 1110. At the same time that the radially extending formation 1850 depicted in FIG. 13 is being moved through the depicted cap opening 1450 into the depicted cap recess 1410, the other of the radially extending formations 1850 (located on the opposite side of the front portion 1111 of the housing 1110, as depicted in FIG. 12) is concurrently being moved through the other of the cap openings 1450 into the other of the cap recesses 1410 (located on the opposite side from the depicted opening and recess 1450, 1410).

Once the radially extending formations 1850 have been inserted through the cap openings 1450 as deeply as possible into the cap recesses 1410 (as depicted by the broken-line showing of the formation 1850 in FIG. 13), the cap 1400 can be rotated about the axis 1101 relative to the housing 1110, in the direction of the arrows 1901 shown in FIG. 14, to move the radially extending formations 1850 past the axially extending wall segments 1462 into portions 1461 of the cap recesses 1410 that are located forwardly of the circumferentially extending wall segments 1460. Continued turning of the cap 1400 about the axis 1101 in the direction of the arrows 1901 shown in FIGS. 14 and 15 will bring the radially extending formations 1850 to the positions shown in FIG. 15 where one edge 1853 of each of the radially extending formations 1850 engages one of the axially extending wall segments 1463. The cap 1400 can not be turned farther in the direction of the arrows 1901 once the radially extending formations 1850 have reached the FIG. 15 positions wherein edges 1853 of the formations 1850 engage the axially extending wall segments 1463.

Figure 16:
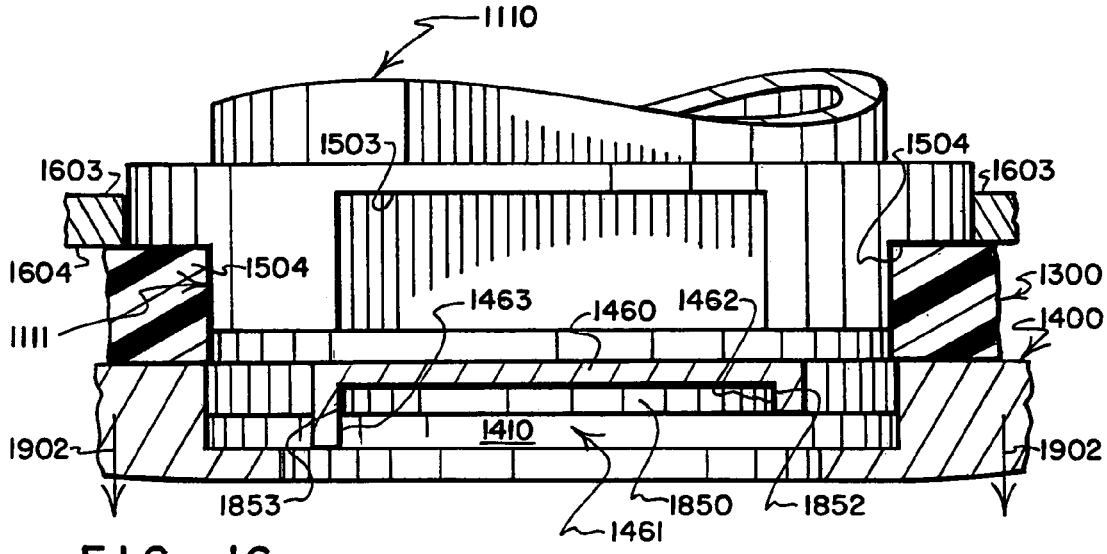

To lock the cap 1400 in place on the housing 1110 at a time after radially extending formations 1850 have reached the position depicted in FIG. 15, the cap 1400 is moved forwardly in a direction indicated by the arrows 1902 in FIG. 16 so that an opposite edge 1852 of the radially extending formation 1850 (i.e., the edge 1852 is located on an opposite end of the formation 1850 from the edge 1853) extends alongside the axially extending wall segment 1462, as is shown in FIG. 16. The cap 1400 cannot be rotated in either direction about the axis 1101 once the radially extending formations 1850 are situated in the cap-defined recess segments 1461 as depicted in FIG. 16.

Turning back to compare what is shown in FIGS. 13 and 14, it will be seen that, as the cap 1400 moves in the direction of the arrows 1900 to bring the radially extending formations 1850 of the housing 1110 into the recesses 1450 of the cap 1400, the foam rubber material of the washer 1300 is compressed by the cap 1400. In fact, the material of the washer 1300 is very tightly compacted or compressed by the cap 1400 as the cap 1400 is being turned in the direction of the arrows 1901 as shown in FIGS. 14 and 15; and, when the cap 1400 moves forwardly in the direction of the arrows 1902 as shown in FIG. 16, the material of the washer 1300 remains significantly compressed by the cap 1400. The washer 1300 is, in fact, so significantly compressed when the cap 1400 is in the position depicted in FIG. 16 that the force exerted by the compressed washer 1300 on the cap (tending to move the cap 1400 in the direction of the arrows 1902 shown in FIG. 16) can be relied on to hold the cap in the position shown in FIG. 16—which is precisely what is needed in order to "lock" the cap 1400 in place on the front portion 1111 of the housing 1110.

A feature of the arrangement just described is that, once the cap 1400 is installed on the panel 998 utilizing the "from the rear" approach just described, it is difficult to remove the cap 1400 because, if the cap 1400 is pushed rearwardly (in a direction opposite to the arrows 1902 shown in FIG. 16) in an effort to reverse the steps that were followed to install the cap 1400 on the housing 1110, the compressed washer 1300 will cause the housing 1110 to move rearwardly (as the cap 1400 is moved rearwardly) just enough to render it nearly impossible for the relative positions of the cap 1400 and the housing 1110 shown in FIG. 15 to be achieved, hence trying to reverse the installation steps to remove the cap 1400 from the housing 1110 is nearly impossible unless the housing 1110 can be firmly gripped from behind the panel 998 and forcefully held forward as the cap 1400 is moved rearwardly to achieve the arrangement shown in FIG. 15 (which must be reached if the cap 1400 is to be rotated relative to the housing 1110 in a direction opposite to the arrows 1901 of FIGS. 14-15) so the cap 1400 can be turned relative to and removed from housing 1110.

As will be apparent from the foregoing description, the present invention provides a push button actuator assembly with a housing of novel configuration and a cap of novel configuration that can be removably installed on the housing that permit the push button actuator assembly to be installed in a panel opening utilizing a "from the rear" installation technique that cannot be used with prior push button actuator assembly proposals. The use of a compressible, resilient, foam rubber washer to serve the dual functions of sealing between the cap and the housing, and retaining the cap in place once the cap is installed on the housing is quite unlike prior proposals and permits push button actuator assemblies (with linkage assemblies already attached thereto) to be installed quickly and easily in panel openings without a need for tools or other apparatus that risks scratching or damaging the panels or other components.

Moreover, additional advantages are offered by the described optional features of the invention, including a cam that is stiffened and rigidified against bending by providing its inner end region with edge portions that are turned out of the plane of the flat central part of the inner end region, and including a three-element seal assembly, the components of which do not wipe or drag on the push button as the push button moves within the housing of the push button actuator.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty exist in the invention disclosed.

The invention claimed is:

1. A push button actuator assembly for engaging and moving a component of another mechanism in response to depression of an operating element of the push button actuator assembly, comprising:

a) a housing having a passage formed therethrough that extends along a central axis of the housing and opens through a forward end region and a rearward end region of the housing;

b) a push button supported in the passage for movement along the central axis and having a front end region and a rear end region, with the front end region of the push button defining said operating element and being configured to be manually engaged so that force can be applied to the front end region of the push button to depress and rearwardly move the push button along the central axis from a first position to a second position;

c) a one-piece elongate cam formed from metal and having a substantially flat first portion defining a rounded first end region extending in a plane that substantially perpendicularly intersects the central axis and being rigidly connected to the rear end region of the push button at a location along the central axis so the cam will move forwardly and rearwardly with the push button, and having a second portion that extends away from the central axis for engaging and moving said component of another mechanism in response to depression and rearward movement of the push button;

d) wherein the rounded first end region defined by the substantially flat first portion is bounded, at least in part, by a curved edge segment of the cam that is turned out of the plane of the flat first portion to form a generally C-shaped arc that curves about and at least partially encircles the central axis, and serves to rigidify at least a part of the cam to resist bending when the cam transmits force from the push button to said component of another mechanism for moving said component.

2. A push button actuator assembly for engaging and moving a component of another mechanism in response to depression of an operating element of the push button actuator assembly, comprising:

a) a housing having a passage formed therethrough that extends along a central axis of the housing and opens through a forward end region and a rearward end region of the housing;

b) a push button supported in the passage for movement along the central axis and having a front end region and a rear end region, with the front end region of the push button defining said operating element and being configured to be manually engaged so that force can be applied to the front end region of the push button to depress and rearwardly move the push button along the central axis from a first position to a second position;

c) a one-piece cam formed from metal and having a substantially flat first portion extending in a plane that substantially perpendicularly intersects the central axis and being rigidly connected to the rear end region of the push button at a location along the central axis so the cam will move forwardly and rearwardly with the push button, and having a second portion that extends away from the central axis for engaging and moving said component of another mechanism in response to depression and rearward movement of the push button;

d) wherein the substantially flat first portion is bounded, at least in part, by a curved edge segment of the cam that is turned out of the plane of the flat first portion and serves to rigidify at least a part of the cam to resist bending when the cam transmits force from the push button to said component of another mechanism for moving said component;

e) wherein the curved edge region forms substantially a half-circle arc about the central axis.

3. The push button actuator assembly of claim 2 wherein the first and second portions of the cam are connected by an intermediate portion of the cam, wherein an inner part of the intermediate portion that connects with the first portion is substantially flat and extends in the plane of the flat first portion, and wherein the intermediate portion is bounded, at least in part, by at least one straight edge segment of the cam that is turned out of the plane of the flat first portion so as to provide a contiguous extension of the curved edge segment to assist the curved edge segment in rigidifying at least a part of the cam to resist bending when the cam transmits force from the push button to said component of another mechanism for moving said component.

4. The push button actuator assembly of claim 3 wherein the at least one straight edge segment includes first and second straight edge segments that bound opposite sides of the intermediate portion and provide contiguous extensions of the curved edge segment.

5. The push button actuator assembly of claim 4 wherein the first and second straight edge segments extend substantially parallel to each other.

6. The push button actuator assembly of claim 1 wherein at least a portion of the push button to which the cam is rigidly connected can be turned about the central axis between an unlocked position wherein the cam is aligned with said component of another mechanism and a locked position wherein the cam is disaligned with said component in response 1) to insertion into the push button of a correctly configured key and 2) to the inserted key being turned about the central axis, with the disalignment of the cam with said component when the cam is turned to the locked position being sufficient to ensure that, when the push button is depressed and moved rearwardly, the cam does not engage and move said component.

7. The push button actuator assembly of claim 6 additionally including an O-ring seal carried in the passage adjacent the forward end region of the housing and extending about a smooth, substantially cylindrical outer surface of the push button to seal the passage from the entry of moisture, with the O-ring engaging only a forwardly facing shoulder of the push button and only when the push button is in the first position.

8. A push button actuator assembly for engaging and moving a component of another mechanism in response to depression of an operating element of the push button actuator assembly, comprising:

a) a housing having a passage formed therethrough that extends along a central axis of the housing and opens through a forward end region and a rearward end region of the housing;

b) a push button supported in the passage for movement along the central axis and having a front end region and a rear end region, with the front end region of the push button defining said operating element and being configured to be manually engaged so that force can be applied to the front end region of the push button to depress and rearwardly move the push button along the central axis from a first position to a second position;

c) a one-piece cam formed from metal and having a substantially flat first portion extending in a plane that substantially perpendicularly intersects the central axis and being rigidly connected to the rear end region of the push button at a location along the central axis so the cam will move forwardly and rearwardly with the push button, and having a second portion that extends away from the central axis for engaging and moving said component of another mechanism in response to depression and rearward movement of the push button;

d) wherein the substantially flat first portion is bounded, at least in part, by a curved edge segment of the cam that is turned out of the plane of the flat first portion and serves to rigidify at least a part of the cam to resist bending when the cam transmits force from the push button to said component of another mechanism for moving said component;

e) additionally including a retainer disc carried in the passage and engaging the O-ring to hold the O-ring in the passage, and a snap ring installed in a groove that opens into the passage to hold the retainer disc in the passage.

9. The push button actuator assembly of claim 8 wherein the retainer disc has a curved surface that faces rearwardly and engages a forward side of the O-ring.

10. The push button actuator assembly of claim 2 wherein the forward end region of the housing has an external configuration suited to be inserted through a panel opening from a rear side of the panel, wherein the push button actuator assembly includes an annular cap that can be easily, manually, removably connected to the forward end region of the housing after the forward end region of the housing has been inserted through the panel opening from the rear side of the panel, and wherein the annular cap has a rearwardly facing shoulder configured to overlie front surface portions of the panel extending about the panel opening to retain the forward end region of the housing in the panel opening when the annular cap has been manually, removably connected to the forward end region of the housing.

11. The push button actuator assembly of claim 10 additionally including a resilient foam rubber washer configured to surround a portion of the forward end region of the housing at a location interposed between the annular cap and the front surface portions of the panel extending about the panel opening.

12. The push button actuator assembly of claim 11 wherein the resilient foam rubber washer has a thickness sufficient to ensure that the washer will be compressed along the central axis when the washer is installed on the forward end region of the housing at said location and the annular cap is removably connected to the forward end region of the housing.

13. The push button actuator assembly of claim 12 wherein the annular cap is removably connected to the forward end region of the housing by inserting radially extending formations of the housing into recesses of the annular cap that are configured to receive the radially extending formations.

14. The push button actuator assembly of claim 13 wherein each of the recesses of the annular cap is configured to receive a separate associated one of the radially extending formations of the housing.

15. A push button actuator assembly for engaging and moving a component of another mechanism in response to depression of an operating element of the push button actuator assembly, comprising:

a) a housing having a passage formed therethrough that extends along a central axis of the housing and opens through a forward end region and a rearward end region of the housing;

b) a push button supported in the passage for movement along the central axis and having a front end region and a rear end region, with the front end region of the push button defining said operating element and being configured to be manually engaged so that force can be applied to the front end region of the push button to depress and rearwardly move the push button along the central axis from a first position to a second position;

c) a one-piece cam formed from metal and having a substantially flat first portion extending in a plane that substantially perpendicularly intersects the central axis and being rigidly connected to the rear end region of the push button at a location along the central axis so the cam will move forwardly and rearwardly with the push button, and having a second portion that extends away from the central axis for engaging and moving said component of another mechanism in response to depression and rearward movement of the push button;

d) wherein the substantially flat first portion is bounded, at least in part, by a curved edge segment of the cam that is turned out of the plane of the flat first portion and serves to rigidify at least a part of the cam to resist bending when the cam transmits force from the push button to said component of another mechanism for moving said component;

e) wherein each of the recesses of the annular cap has a rearwardly facing opening configured to receive a separate associated one of the radially extending formations of the housing therein when the cap is moved rearwardly along the central axis relative to the housing; has a circumferentially extending passage connected to the rearwardly facing opening configured to receive the separate associated one of the radially extending formations when the cap is rotated about the central axis relative to the housing at a time when the separate associated one of the radially extending formations is received in the rearwardly facing opening; and has a rearwardly extending region connected to the circumferentially extending passage configured to receive the separate associated one of the radially extending formations therein when the cap is moved forwardly along the central axis relative to the housing at a time when the separate associated one of the radially extending formations is positioned in the circumferentially extending passage in alignment with the rearwardly extending region, with the rearwardly extending region being configured to prevent the cap from being turned about the central axis so long as the separate associated one of the radially extending formations is seated in a rearward end region of the rearwardly extending region.

16. The push button actuator assembly of claim 15 wherein the resilient washer compressed between the panel and the rearwardly facing shoulder of the annular cap biases the cap forwardly to thereby maintain the separate associated one of the radially extending formations seated in the rearwardly extending region.

17. A push button actuator assembly for engaging and moving a component of another mechanism in response to depression of an operating element of the push button actuator assembly, comprising:

a) a housing having a passage formed therethrough that extends along a central axis of the housing and opens through a forward end region and a rearward end region of the housing;

b) a push button supported in the passage for movement along the central axis and having a front end region and a rear end region, with the front end region of the push button defining said operating element and being configured to be manually engaged so that force can be applied to the front end region of the push button to depress and rearwardly move the push button along the central axis from a first position to a second position;

c) a cam having a first portion rigidly connected to the rear end region of the push button at a location along the central axis so the cam will move forwardly and rearwardly with the push button, and having a second portion that extends away from the central axis for engaging and moving said component of another mechanism in response to depression and rearward movement of the push button;

d) wherein the forward end region of the housing has an external configuration smaller in size than a panel opening and therefore suited to be inserted through the panel opening from a rear side of the panel, wherein the push button actuator assembly includes an annular cap larger in size than the panel opening that can be easily, manually, removably connected to the forward end region of the housing after the smaller in size forward end region of the housing has been inserted through the panel opening from the rear side of the panel, and wherein the annular cap has a rearwardly facing shoulder larger in size than the panel opening and configured to overlie front surface portions of the panel extending about the panel opening to retain the smaller in size forward end region of the housing in the panel opening when the annular cap has been manually, removably connected to the smaller in size forward end region of the housing; and, e) wherein the annular cap is removably connected to the smaller in size forward end region of the housing by inserting radially extending formations of the housing into recesses of the annular cap that are configured to receive the radially extending formations.

18. A push button actuator assembly for engaging and moving a component of another mechanism in response to depression of an operating element of the push button actuator assembly, comprising:

a) a housing having a passage formed therethrough that extends along a central axis of the housing and opens through a forward end region and a rearward end region of the housing;

b) a push button supported in the passage for movement along the central axis and having a front end region and a rear end region, with the front end region of the push button defining said operating element and being configured to be manually engaged so that force can be applied to the front end region of the push button to depress and rearwardly move the push button along the central axis from a first position to a second position;

c) a cam having a first portion rigidly connected to the rear end region of the push button at a location along the central axis so the cam will move forwardly and rearwardly with the push button, and having a second portion that extends away from the central axis for engaging and moving said component of another mechanism in response to depression and rearward movement of the push button;

d) wherein the forward end region of the housing has an external configuration suited to be inserted through a panel opening from a rear side of the panel, wherein the push button actuator assembly includes an annular cap that can be easily, manually, removably connected to the forward end region of the housing after the forward end region of the housing has been inserted through the panel opening from the rear side of the panel, and wherein the annular cap has a rearwardly facing shoulder configured to overlie front surface portions of the panel extending about the panel opening to retain the forward end region of the housing in the panel opening when the annular cap has been manually, removably connected to the forward end region of the housing;

e) wherein the annular cap is removably connected to the forward end region of the housing by inserting radially extending formations of the housing into recesses of the annular cap that are configured to receive the radially extending formations; and, f) a resilient foam rubber washer configured to surround a portion of the forward end region of the housing at a location interposed between the annular cap and the front surface portions of the panel extending about the panel opening.

19. The push button actuator assembly of claim 18 wherein the resilient foam rubber washer has a thickness sufficient to ensure that the washer will be compressed along the central axis when the washer is installed on the forward end region of the housing at said location and the annular cap is removably connected to the forward end region of the housing.

20. The push button actuator assembly of claim 17 wherein each of the recesses of the annular cap is configured to receive a separate associated one of the radially extending formations of the housing.

21. A push button actuator assembly for engaging and moving a component of another mechanism in response to depression of an operating element of the push button actuator assembly, comprising:

a) a housing having a passage formed therethrough that extends along a central axis of the housing and opens through a forward end region and a rearward end region of the housing;

b) a push button supported in the passage for movement along the central axis and having a front end region and a rear end region, with the front end region of the push button defining said operating element and being configured to be manually engaged so that force can be applied to the front end region of the push button to depress and rearwardly move the push button along the central axis from a first position to a second position;

c) a cam having a first portion rigidly connected to the rear end region of the push button at a location along the central axis so the cam will move forwardly and rearwardly with the push button, and having a second portion that extends away from the central axis for engaging and moving said component of another mechanism in response to depression and rearward movement of the push button;

d) wherein the forward end region of the housing has an external configuration suited to be inserted through a panel opening from a rear side of the panel, wherein the push button actuator assembly includes an annular cap that can be removably connected to the forward end region of the housing after the forward end region of the housing has been inserted through the panel opening from the rear side of the panel, and wherein the annular cap has a rearwardly facing shoulder configured to overlie front surface portions of the panel extending about the panel opening to retain the forward end region of the housing in the panel opening when the annular cap is connected to the forward end region of the housing;

e) wherein the annular cap is removably connected to the forward end region of the housing by inserting radially extending formations of the housing into recesses of the annular cap that are configured to receive the radially extending formations;

f) wherein each of the recesses of the annular cap is configured to receive a separate associated one of the radially extending formations of the housing; and, g) wherein each of the recesses of the annular cap has a rearwardly facing opening configured to receive a separate associated one of the radially extending formations of the housing therein when the cap is moved rearwardly along the central axis relative to the housing; has a circumferentially extending passage connected to the rearwardly facing opening configured to receive the separate associated one of the radially extending formations when the cap is rotated about the central axis relative to the housing at a time when the separate associated one of the radially extending formations is received in the rearwardly facing opening; and has a rearwardly extending region connected to the circumferentially extending passage configured to receive the separate associated one of the radially extending formations therein when the cap is moved forwardly along the central axis relative to the housing at a time when the separate associated one of the radially extending formations is positioned in the circumferentially extending passage in alignment with the rearwardly extending region, with the rearwardly extending region being configured to prevent the cap from being turned about the central axis so long as the separate associated one of the radially extending formations is seated in a rearward end region of the rearwardly extending region.

22. The push button actuator assembly of claim 21 additionally including a resilient foam rubber washer configured to surround a portion of the forward end region of the housing at a location interposed between the annular cap and the front surface portions of the panel extending about the panel opening.

23. The push button actuator assembly of claim 22 wherein the resilient foam rubber washer has a thickness sufficient to ensure that the washer will be compressed along the central axis when the washer is installed on the forward end region of the housing at said location and the annular cap is removably connected to the forward end region of the housing.

24. The push button actuator assembly of claim 23 wherein the resilient washer compressed between the panel and the rearwardly facing shoulder of the annular cap biases the cap forwardly to thereby maintain the separate associated one of the radially extending formations seated in the rearward end region of the rearwardly extending region.

25. A push button operator assembly mountable in a panel opening, comprising:

a) a housing having a front exterior portion of generally cylindrical shape insertable forwardly through the panel opening from a rear side of the panel and having an interior configured to surround a central passage wherein a push button is supported for translation relative to the housing along an imaginary forwardly-rearwardly extending central axis of the central passage between a normally extended position and a depressed position, and at least one spring connected to the housing and biasing the push button forwardly away from the depressed position toward the extended position;

b) a generally annular cap that is easily, manually, removably connectable to the front exterior portion of the housing after the front exterior portion of the housing has been inserted through the panel opening from the rear side of the panel and configured to surround a front portion of the push button passage, wherein a rear portion of the cap defines a rearwardly facing shoulder configured to overlie front surface portions of the panel in the vicinity of the panel opening to prevent the housing from being withdrawn rearwardly from the panel opening once the annular cap has been manually, removably connected to the front exterior portion of the housing;

c) wherein the front exterior portion of the housing and the rear portion of the cap are provided with radially extending formations that can be brought into a first overlying relationship by rotating the housing and the cap relative to each other about the central axis to thereby establish said connection; and, d) wherein the front exterior portion of the housing and the rear portion of the cap also are provided with axially extending surfaces that can be brought into a second overlying relationship by axially moving the cap forwardly relative to the housing while the first overlying relationship is maintained to thereby prevent such relative rotation of the cap and the housing as would disestablish the first overlying relationship.

26. A push button operator assembly mountable in a panel opening, comprising:

a) a housing having a front exterior portion of generally cylindrical shape insertable forwardly through the panel opening from a rear side of the panel and having an interior configured to surround a central passage wherein a push button is supported for translation relative to the housing along an imaginary forwardly-rearwardly extending central axis of the central passage between a normally extended position and a depressed position, and at least one spring connected to the housing and biasing the push button forwardly away from the depressed position toward the extended position;

b) a generally annular cap connectable to the front exterior portion of the housing after the front exterior portion of the housing has been inserted through the panel opening from the rear side of the panel and configured to surround a front portion of the push button passage, wherein a rear portion of the cap defines a rearwardly facing shoulder configured to overlie front surface portions of the panel in the vicinity of the panel opening to prevent the housing from being withdrawn rearwardly from the panel opening once a connection has been established between the cap and the housing;

c) wherein the front exterior portion of the housing and the rear portion of the cap are provided with radially extending formations that can be brought into a first overlying relationship by rotating the housing and the cap relative to each other about the central axis to thereby establish said connection;

d) wherein the front exterior portion of the housing and the rear portion of the cap also are provided with axially extending surfaces that can be brought into a second overlying relationship by axially moving the cap forwardly relative to the housing while the first overlying relationship is maintained to thereby prevent such relative rotation of the cap and the housing as would disestablish the first overlying relationship;

e) wherein the radially extending formation of the housing defines a first radially extending surface that extends through an arc which extends about the central axis, wherein the radially extending formation of the cap defines a second radially extending surface that faces toward and overlies the first radially extending surface when the first overlying relationship is established, and wherein the housing and the cap are configured a) such that the first and second radially extending surfaces are caused to extend in spaced-apart planes as the housing and the cap are turned relative to each other to establish the first overlying relationship, and b) such that the first and second radially extending surfaces are brought into engagement with each other when the housing and the cap are moved axially relative to each other to establish the second overlying relationship.

27. The assembly of claim 26 wherein the housing defines a forwardly facing shoulder configured to overlie rear surface portions of the panel in the vicinity of the panel opening to prevent the housing from being withdrawn forwardly from the panel opening once a connection has been established between the cap and the housing.

28. The assembly of claim 27 additionally including a resilient annular member having an opening through which the exterior portion of the housing may be inserted so the resilient annular member can be installed on the front exterior portion of the housing at a location between the forwardly facing shoulder and the rearwardly facing shoulder.

29. The assembly of claim 28 wherein such portions of the resilient annular member and such portions of the panel as are situated between the forwardly and rearwardly extending shoulders when said connection is established are selected so the resilient annular member is caused to be compressed during establishment of the first and second overlying relationships, whereby the compression of the resilient annular member biases the first and second radially extending surfaces toward engagement with each other when once the first and second overlying relationships are established.

30. A push button operator assembly mountable in a panel opening, comprising:

a) a housing having a front exterior portion of generally cylindrical shape insertable forwardly through the panel opening from a rear side of the panel and having an interior configured to surround a central passage wherein a push button is supported for translation relative to the housing along an imaginary forwardly-rearwardly extending central axis of the central passage between a normally extended position and a depressed position, and at least one spring connected to the housing and biasing the push button forwardly away from the depressed position toward the extended position;

b) a generally annular cap connectable to the front exterior portion of the housing after the front exterior portion of the housing has been inserted through the panel opening from the rear side of the panel and configured to surround a front portion of the push button passage, wherein a rear portion of the cap defines a rearwardly facing shoulder configured to overlie front surface portions of the panel in the vicinity of the panel opening to prevent the housing from being withdrawn rearwardly from the panel opening once a connection has been established between the cap and the housing;

c) wherein the front exterior portion of the housing and the rear portion of the cap are provided with radially extending formations that can be brought into a first overlying relationship by rotating the housing and the cap relative to each other about the central axis to thereby establish said connection;

d) wherein the front exterior portion of the housing and the rear portion of the cap also are provided with axially extending surfaces that can be brought into a second overlying relationship by axially moving the cap forwardly relative to the housing while the first overlying relationship is maintained to thereby prevent such relative rotation of the cap and the housing as would disestablish the first overlying relationship;

e) additionally including a cam having a substantially flat inner end region extending in a first plane substantially perpendicularly intersected by the central axis, with the flat inner end region being connected to a rear end region of the push button, and with the flat inner end region being rigidified by being joined by substantially a right angle bend to an arcuate formation that extends out of the first plane to form a generally C-shaped arc that curves about and at least partially encircles the central axis.

31. The assembly of claim 30 wherein the arcuate formation has an edge surface, portions of which extend in a second plane spaced from and extending substantially parallel to the first plane.

32. The assembly of claim 31 wherein the arcuate formation curves about 180 degrees around the central axis.

33. A push button operator assembly, comprising:

a) a housing having an interior configured to surround a central passage wherein a push button is supported for translation relative to the housing along an imaginary forwardly-rearwardly extending central axis of the central passage between a normally extended position and a depressed position, and at least one spring connected to the housing and biasing the push button forwardly away from the depressed position toward the extended position; and, b) an elongate cam having a substantially flat inner end region extending in a first plane substantially perpendicularly intersected by the central axis, with the flat inner end region being connected to a rear end region of the push button, and with the flat inner end region being rigidified by being joined by substantially a right angle bend to a formation that extends out of the first plane to define a substantially C-shaped arc that curves about and at least partially encircles the central axis.

34. The assembly of claim 33 wherein the arcuate formation has an edge surface, portions of which extend in a second plane spaced from and extending substantially parallel to the first plane.

35. The assembly of claim 34 wherein the arcuate formation curves through a range of between about 135 to about 180 degrees about the central axis.

36. A push button actuator assembly having a housing, a push button translatably movable in a forwardly and rearwardly extending passage of the housing along a central axis of the passage, an engagement member carried by a rear end region of the push button for engaging and moving an operating element of another apparatus in response to rearward movement of the push button along the central axis in opposition to a spring interposed between the push button and the housing that biases the push button forwardly along the axis, and an annular cap that can be easily, manually, removably connected to a front portion of the housing, wherein the cap has a rearwardly opening recess configured to receive the front portion of the housing therein at a time after the front portion has been inserted from behind a panel through an opening defined by the panel, wherein the recess and the front portion are configured to latch together as the result of the cap and the housing first being moved along the central axis toward each other to bring the front portion into the recess, second being rotated relative to each other about the central axis to bring elements of the cap and housing into overlying relationship, and third being moved along the central axis a short distance away from each other to a fully installed position of the cap to manually, removably connect the cap to the front portion of the housing.

37. The push button actuator assembly of claim 36 additionally including a compressible, resilient, foam rubber member installable about the front portion of the housing at a location between the panel and the cap for being compressed between the panel and the cap so as to apply a biasing force to the cap tending to move the cap forwardly along the central axis to thereby retain the cap in the fully installed position.

38. The push button actuator assembly of claim 37 wherein the foam rubber member is a foam rubber washer of substantially uniform thickness having an opening formed centrally therethrough that permits the washer to be installed on the front portion of the housing.

* * * * *